US010408436B2

(12) United States Patent
Wronski et al.

(10) Patent No.: US 10,408,436 B2
(45) Date of Patent: Sep. 10, 2019

(54) TAPERED LIGHTING FIXTURE JUNCTION BOX

(71) Applicant: Cooper Technologies Company, Houston, TX (US)

(72) Inventors: Grzegorz Wronski, Peachtree City, GA (US); Zhihong Lin, Shanghai (CN); Steven Pyshos, Peachtree City, GA (US)

(73) Assignee: Eaton Intelligent Power Limited, Dublin (IE)

( * ) Notice: Subject to any disclaimer, the term of this patent is extended or adjusted under 35 U.S.C. 154(b) by 778 days.

(21) Appl. No.: 14/804,062

(22) Filed: Jul. 20, 2015

(65) Prior Publication Data

US 2016/0018073 A1 Jan. 21, 2016

Related U.S. Application Data

(63) Continuation of application No. 14/242,535, filed on Apr. 1, 2014, now Pat. No. 9,086,198.

(Continued)

(51) Int. Cl.

*F21V 21/00* (2006.01)
*F21V 21/04* (2006.01)

(Continued)

(52) U.S. Cl.

CPC ..... *F21V 21/04* (2013.01); *F21S 8/02* (2013.01); *F21S 8/026* (2013.01); *F21V 21/042* (2013.01);

(Continued)

(58) Field of Classification Search

CPC ... H02G 3/08–20; F21V 21/04; F21V 21/042; F21V 21/047

(Continued)

(56) References Cited

U.S. PATENT DOCUMENTS 3,018,082 A 1/1962 Berger
3,720,432 A 3/1973 Chudler (Continued)

FOREIGN PATENT DOCUMENTS

CN 1170455 1/1998
EP 1353116 10/2003

(Continued)

OTHER PUBLICATIONS

Thomas Lighting; Product specification; PS5RM; 5" Recessed Housing; Jun. 12, 2013.

(Continued)

*Primary Examiner* — Gerald J Sufleta, II

(74) *Attorney, Agent, or Firm* — King & Spalding LLP

(57) ABSTRACT

A retention structure for retaining a recessed lighting fixture behind a ceiling includes an attachment structure that has a first wall and a second wall. The attachment structure is designed to be attached to a housing of a recessed light fixture. The retention structure further includes a screw attached to the first wall of the attachment structure and to the second wall of the attachment structure. The retention structure also includes a pawl attached to the threaded screw. The pawl is rotatable along with the threaded screw. The pawl is also axially movable along the threaded screw between the first wall of the attachment structure and the second wall of the attachment structure.

7 Claims, 45 Drawing Sheets

Related U.S. Application Data

(60) Provisional application No. 61/891,284, filed on Oct. 15, 2013.

(51) Int. Cl.

| | |
|---|---|
| ***F21S 8/02*** | (2006.01) |
| *F21V 21/02* | (2006.01) |
| *F21V 21/03* | (2006.01) |
| *F21V 21/06* | (2006.01) |

(52) U.S. Cl.
CPC ..... *F21V 21/047* (2013.01); *F21V 21/02* (2013.01); *F21V 21/03* (2013.01); *F21V 21/049* (2013.01); *F21V 21/06* (2013.01); *Y10T 29/49963* (2015.01)

(58) Field of Classification Search
USPC ..... 362/364; 220/3.2, 3.3, 3.8
See application file for complete search history.

(56) References Cited

U.S. PATENT DOCUMENTS

| | | | | |
|---|---|---|---|---|
| 5,452,816 | A | 9/1995 | Chan et al. | |
| 5,457,617 | A | 10/1995 | Chan et al. | |
| 5,562,343 | A | 10/1996 | Chan et al. | |
| 5,957,572 | A | 9/1999 | Wedekind et al. | |
| 5,957,573 | A | 9/1999 | Wedekind et al. | |
| 5,967,640 | A | 10/1999 | Moriyama et al. | |
| 6,095,660 | A | 8/2000 | Moriyama et al. | |
| 6,132,069 | A | 10/2000 | Sato et al. | |
| 6,588,922 | B1 | 7/2003 | DeCicco | |
| 6,779,910 | B1 * | 8/2004 | Pelton | F21S 8/02 362/260 |
| D545,988 | S * | 7/2007 | Goetz-Schaefer | D26/71 |
| 7,530,705 | B2 | 5/2009 | Czech et al. | |
| 7,530,717 | B2 | 5/2009 | Magisano et al. | |
| 7,731,130 | B2 | 6/2010 | Decanio et al. | |
| 2003/0161155 | A1 | 8/2003 | Caluori | |
| 2003/0223240 | A1 * | 12/2003 | Houle | F21V 21/04 362/364 |
| 2007/0181764 | A1 | 8/2007 | Fehrenbach | |
| 2010/0252703 | A1 | 10/2010 | Wright | |
| 2012/0277749 | A1 | 11/2012 | Mootien et al. | |
| 2014/0307445 | A1 * | 10/2014 | Highbridge | F21V 23/008 362/296.01 |

FOREIGN PATENT DOCUMENTS

| | | |
|---|---|---|
| EP | 1617128 | 1/2006 |
| EP | 2320136 | 5/2011 |
| GB | 2405462 | 3/2005 |
| JP | H1040734 | 2/1998 |
| RU | 101776 | 1/2011 |

OTHER PUBLICATIONS

Thomas Lighting; Product specification; PS1RM; 6" Recessed Housing; Jun. 12, 2013.
Juno Lighting; Product specification; 6" Deluxe Universal TC Remodel Housing; TC2R; Aug. 2009.
Juno Lighting; Product specification; 6" Economy Universal IC Remodel Housing; IC22R; Oct. 2009.
Progress Lighting; Product specification; 6" Remodel Housing IC, Non-IC; Mar. 2006.
Nora Lighting; Product specification; NHRIC-501QAT; 5" IC Housing; Jan. 2, 2002.
WAC Lighting; Product specification; R-603D-R-ICA; 6" Line Voltage Remodel Housing 120V-IC Rated-Airtight Ready; Apr. 2014.
Prescolite; LiteBox-Light Commercial and Residential Downlights; Catalog; Jan. 2009.
Lithonia Lighting; Residential Recessed Downlighting Guide; Feb. 2014.
Search Report for European application No. 14853734.3, dated Feb. 17, 2017.
International Search Report for PCT/US2014/032547, dated Aug. 28, 2014.

* cited by examiner

TAPERED LIGHTING FIXTURE JUNCTION BOX

RELATED APPLICATION

The present application is a continuation of and claims priority to U.S. patent application Ser. No. 14/242,535, titled "Luminaire Retention," and filed on Apr. 1, 2014, which claims priority under 35 U.S.C. § 119(e) to U.S. Provisional Patent Application No. 61/891,284, titled "Rotatable Junction Box Assembly, Interconnecting Luminaire Housing Ends and Luminaire Retention," and filed on Oct. 15, 2013, the contents of which are incorporated herein in by reference.

TECHNICAL FIELD

The present disclosure relates generally to lighting fixtures, and more particularly to retaining a lighting fixture behind a structure such as a ceiling.

BACKGROUND

A recessed luminaire typically needs to be retained in a structure, such as a ceiling. A retention structure or system may be used to retain the recessed luminaire behind the ceiling. For example, the retaining structure or system may be used to retain the housing of the recessed luminaire that has other lighting components, such as a light source, disposed therein. One method of retaining the recessed luminaire behind a ceiling includes use of attachment bars that are attached to structures such as joists or T-bars. Another method of retaining the recessed luminaire behind a ceiling includes use of cables to suspend the recessed luminaire.

In some instances, a luminaire retention structure that eliminates the need to install a hanger bar or cable behind a ceiling may be desirable. In some circumstances, such a luminaire retention structure may allow faster installation of recessed luminaries.

SUMMARY

The present disclosure relates to retaining a lighting fixture behind a structure such as a ceiling. In an example embodiment, a retention structure for retaining a recessed lighting fixture behind a ceiling includes an attachment structure that has a first wall and a second wall. The attachment structure is designed to be attached to a housing of a light fixture. The retention structure further includes a screw attached to the first wall of the attachment structure and to the second wall of the attachment structure. The retention structure also includes a pawl attached to the threaded screw. The pawl is rotatable along with the threaded screw. The pawl is also axially movable along the threaded screw between the first wall of the attachment structure and the second wall of the attachment structure.

In another example embodiment, a lighting structure for a recessed lighting fixture includes a lighting fixture housing that has a window. The lighting structure further includes a retention structure. The retention structure includes an attachment structure that has a first wall and a second wall. The attachment structure is attached the lighting fixture housing. The retention structure further includes a threaded screw attached to the first wall of the attachment structure and to the second wall of the attachment structure. The threaded screw extends across the window of the lighting fixture housing. The retention structure also includes a pawl attached to the threaded screw. The pawl is rotatable along with the threaded screw. The pawl is also axially movable along the threaded screw between the first wall of the attachment structure and the second wall of the attachment structure.

In another example embodiment, a method of installing a recessed lighting fixture behind a ceiling includes inserting a lighting structure including a housing and a retention structure through an opening of a ceiling. The retention structure is attached to the housing. The retention structure includes a pawl attached to a screw. An opening of the housing faces an area below the ceiling after the lighting structure is inserted through the opening of the ceiling. The method further includes rotating the screw to rotate the pawl to a rotational position away from the housing on a side of the ceiling facing away from the area below the ceiling. The screw is accessible through the opening of the housing.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1A:
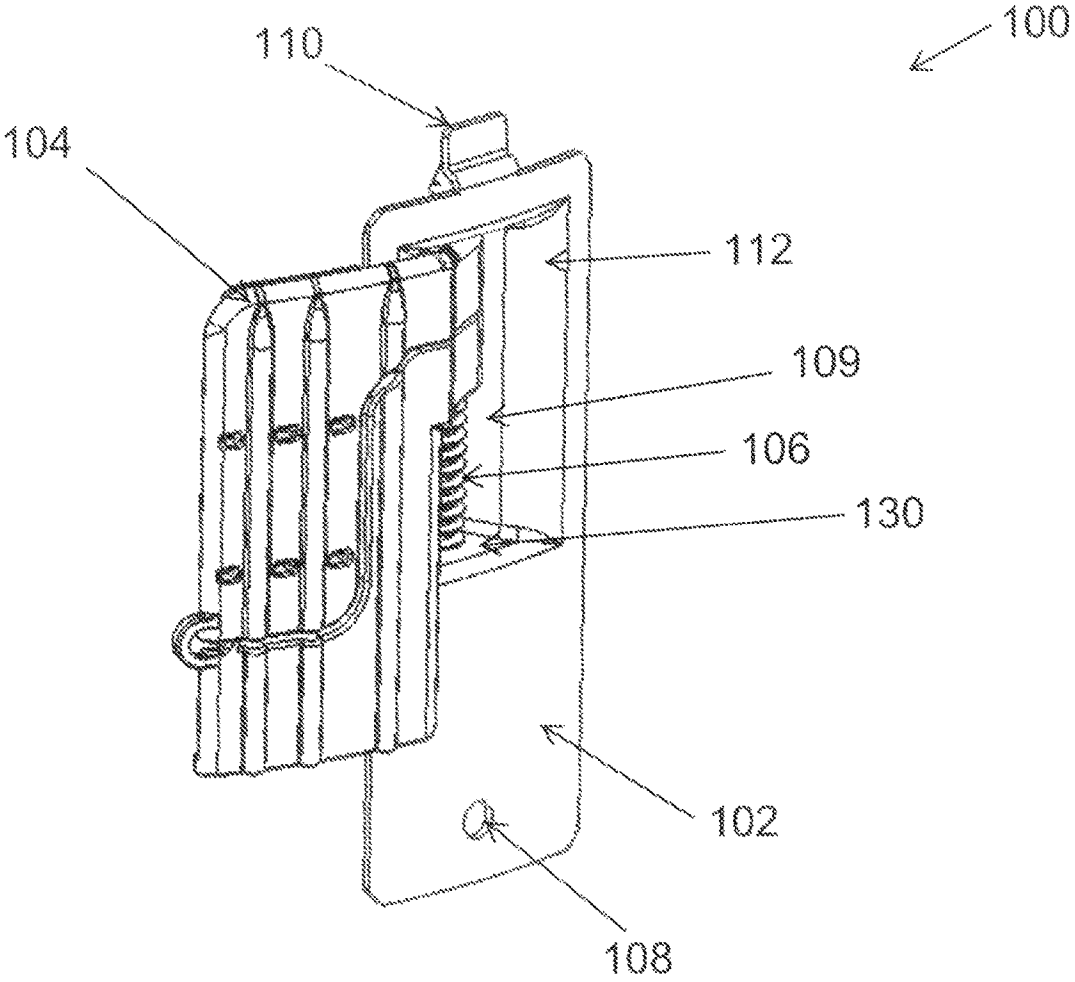
FIGS. 1A-1C illustrate views of a lighting fixture retention structure according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Figure 1B:
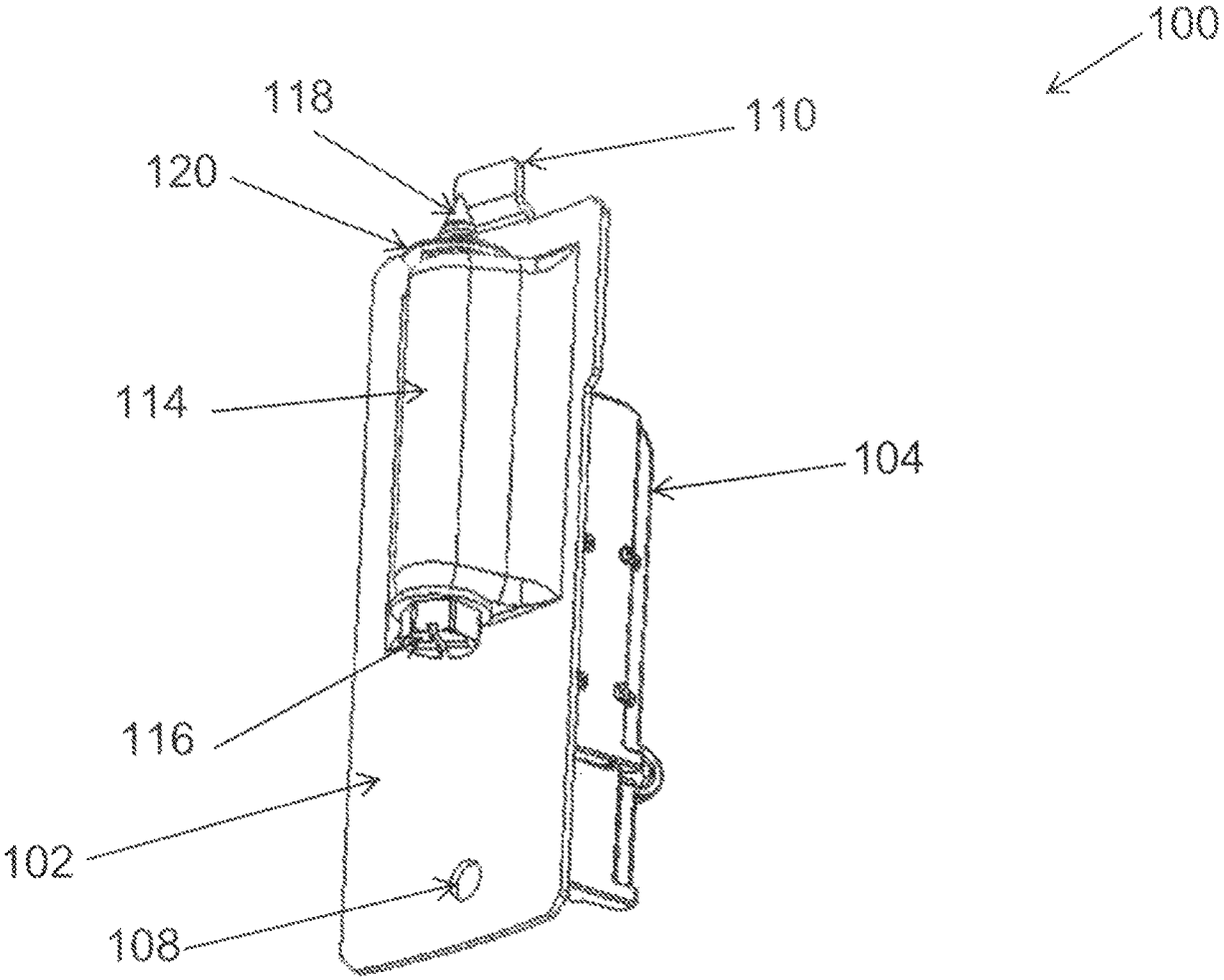
Figure 1C:
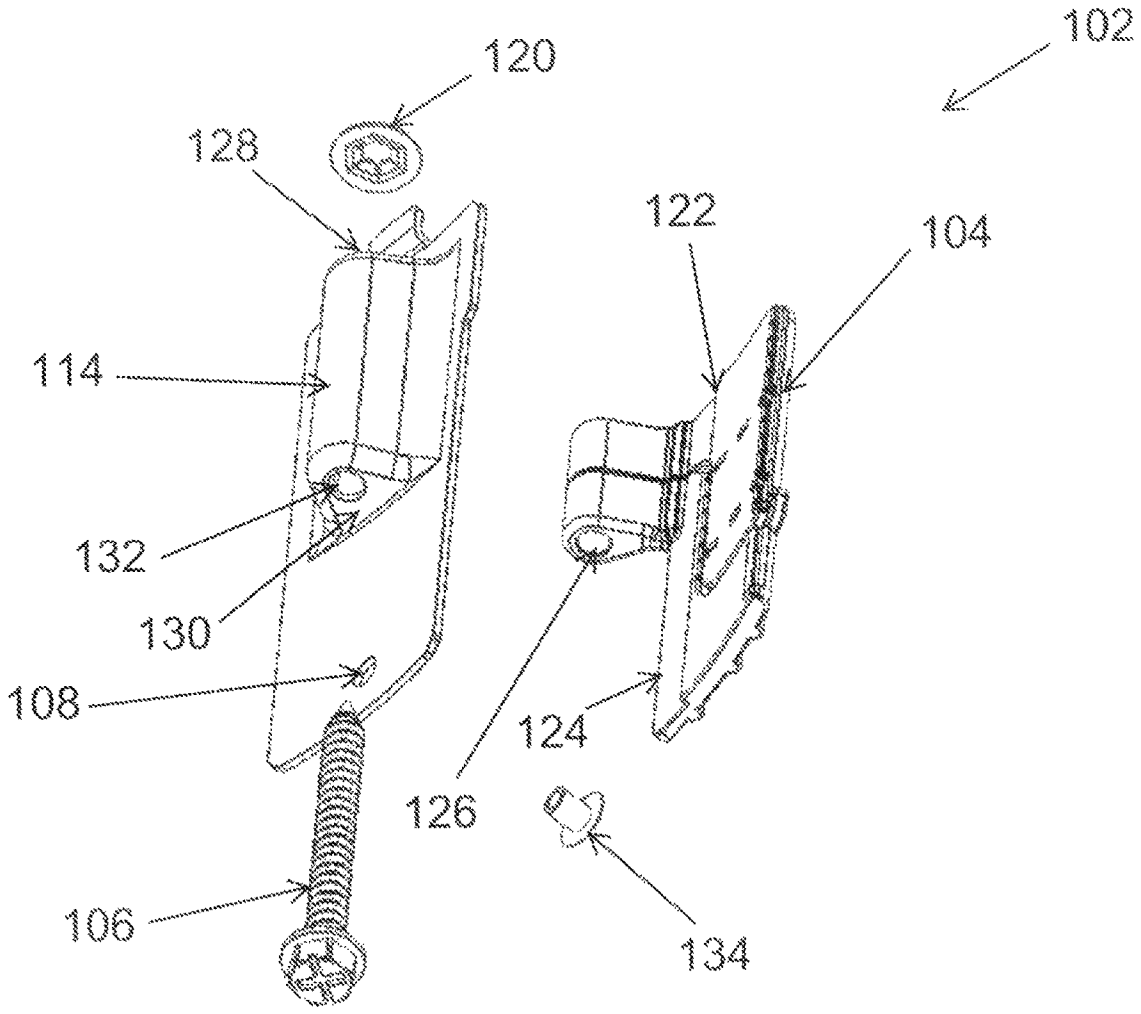

Turning now to the drawings, FIGS. 1A-1C illustrate views of a lighting fixture retention structure 100 according to an example embodiment. The lighting fixture retention structure 100 may be used to retain a lighting fixture behind a structure such as a ceiling or a similar structure. In some example embodiments, the retention structure 100 includes an attachment structure 102 and a pawl 104. The retention structure 100 further includes a screw 106 that may be threaded. The attachment structure 102 is designed to be attached to a housing of a lighting fixture such as a recessed lighting fixture.

In some example embodiments, the attachment structure 102 includes a top wall 128 and a bottom wall 130. The attachment structure 102 may also include a back wall 114 extending between the top wall 128 and the bottom wall 130. The back wall 114 has a wall section 112 on one side of the attachment structure 102. In some example embodiments, the screw 106 is attached to the top wall 128 and to the bottom wall 130. For example, the screw 106 may be inserted through a hole 132 in the bottom wall 130 and through a similar hole in the top wall 128. In some example embodiments, the attachment structure 102 may have a cavity 109 defined by the top wall 128, the bottom wall 130, and the back wall 114. For example, the screw 106 may extend between the top wall 128 and the bottom wall 130 through the cavity 109. In some alternative embodiments, at least a portion of the back wall 114 may be omitted.

In some example embodiments, attachment structure 102 further includes an attachment hole 108 and an attachment tab 110 for attaching the attachment structure 102 to a housing (shown in FIG. 3A) of a lighting fixture such as a recessed lighting fixture. For example, the attachment hole 108 is designed to receive a fastener 134 to attach the attachment structure 102 to the housing. The attachment tab 110 is designed for insertion into a tab slot of the housing of the lighting fixture to attach the attachment structure 102 to the housing. In some alternative embodiments, the attachment tab 110 may be omitted from the attachment structure 102, and the attachment structure 102 may instead include two or more attachment holes 108 for receiving a respective fastener 134. Alternatively, the attachment tab 110 may be positioned proximal to a top end of the attachment structure 102, and the attachment hole 108 may be disposed at a bottom end of the attachment structure 102.

In some example embodiments, the pawl 104 is attached to the screw 106. To illustrate, the pawl 104 includes a passageway 126 that may be internally threaded. The screw 106 passes through the passageway 126 as the screw 106 extends between the top wall 128 and the bottom wall 130. To illustrate, the screw 106 may be attached to the top wall 128 by inserting the screw 106 through the hole 132 of the bottom wall 130 and rotating the screw through the passageway 126 of the pawl 104 until a tip 118 of the screw 106 extends through the hole in the top wall 128. A nut 120 may be attached to the screw 106 after the screw 106 (for example, the tip 118 of the screw 106) passes through the hole in the top wall 128. In some example embodiments, the nut 120 may instead be a retainer washer or another similar structure. A head 116 of the screw 106 remains below the bottom wall 130 of the attachment structure 102.

In some example embodiments, the pawl 104 is rotatable along with the screw 106 extending through the passageway 126. For example, the pawl 104 is in a first rotational position (e.g., a collapsed rotational position) in FIG. 1A, and the pawl 104 is in a second rotational position (e.g., extended rotational position) in FIG. 1B. To illustrate, the pawl 104 may be rotatable along with the threaded screw between the first rotational position and the second rotational position in response to the screw 106 being rotated. For example, a tool such as a screw driver may be used to rotate the screw. When the screw 106 may be rotated, because the pawl 104 is threadedly attached to the screw 106, the pawl 104 may rotate until the pawl 104 encounters a structure that prevents the pawl 104 from rotating along with the screw 106. For example, the pawl 104 may rotate along with the screw 106 until the attachment structure 102 (e.g., the wall section 112) prevents the pawl 104 from rotating further. When the pawl 104 is rotated from the collapsed rotational position to another rotational position such as the extended rotation position shown in FIG. 1B, the retention structure 100 is designed to retain a lighting fixture housing that is attached to the retention structure 100 in a recessed position.

In some example embodiments, the pawl 104 may also be axially movable along the screw 106 between the top wall 128 of the attachment structure 102 and the bottom wall 130 of the attachment structure 102. For example, the pawl 104 may be axially movable along the screw 106 in response to the screw 106 being rotated. To illustrate, the pawl 104 may move axially along the screw 106 when the pawl 104 is prevented from rotating along with the screw 106. For example, the attachment structure 102 may prevent the pawl 104 from further rotation after the pawl 104 is rotated to the collapsed rotational position shown in FIG. 1A or to the extended rotational position shown in FIG. 1B.

In some example embodiments, the pawl 104 includes an upper segment 122 and a lower segment 124, and the passageway 126 extends through both the upper segment 122 and the lower segment 124. In some example embodiments, the upper segment 122 and the lower segment rotate along with the screw 106 when the screw 106 is rotated. Alternatively, only the upper segment 122 or only one or more sections of the upper segment 122 rotate along with the screw 106.

In some example embodiments, the attachment structure 102 may be formed by a stamping and/or an injection molding process. In other examples, the attachment structure 102 may be formed using only an injection molding process. In some example embodiments, the attachment structure 102 may be made from plastic, die casted metal, or sheet metal. The die casted metal may be, for example zinc, magnesium, or aluminum. The sheet metal may be steel or aluminum sheet metal. In some example embodiments, the attachment structure 102 may also be made from steel. The screw 106 and the nut 120 may also be made from plastic or metal.

FIGS. 2A-2D illustrate views of the pawl 104 of the retention structure 100 of FIGS. 1A-1C according to an example embodiment. The pawl 104 includes the upper segment 122 and the lower segment 124. In some example embodiments, the pawl 104 further includes a bridge segment 206 coupled to the upper segment 122 and to the lower segment 124. To illustrate, the bridge segment 206 may be severable, for example, by cutting the bridge segment 206. After the bridge segment 206 is severed, the upper segment 122 may be rotatable along with the screw 106 independent of the lower segment 124.

In some example embodiments, the upper segment 122 includes a wing segment 202 and an attachment segment 222. Similarly, the lower segment 124 may include a wing segment 204 and an attachment segment 224. The passageway 126 of the pawl 104 extends through the attachment segment 222 of the upper segment 122 and through the attachment segment 224 of the lower segment 124. As described above, the passageway 126 may be internally threaded to receive the screw 106 shown in FIG. 1A.

In some example embodiments, the wing segment 202 of the upper segment 122 includes a first wing section 208, a second wing section 210, and a third wing section 212. The wing segment 202 of the upper segment 122 also includes score lines 214, 216 (shown in the respective dotted oval for illustrative purposes). The score lines 214, 216 may serve to identify locations on the wing segment 202 that the wing segment 202 may be cut to accommodate ceilings with different thicknesses. The score lines 214, 216 may also ease cutting or breaking the wing segment 202 for use with a designed ceiling thickness. The score line 216 is disposed between the first wing section 208 and the second wing section 210. The score ling 214 is disposed between the second wing section 210 and the third wing section 212. In some example embodiments, cutting at both score lines 214, 216 results in the second wing section 210 being fully detaching from the pawl 104. Although two score lines 214, 216 are shown in FIGS. 2A-2D, in alternative embodiments, the retention structure 100 may include fewer or more than two score lines. Further, the spacing between the score lines 214, 216 may be unequal.

In some example embodiments, the wing segment 202 of the upper segment 122 and the wing segment 204 of the lower segment 124 have a gap 226 therebetween. In some example embodiments, the gap 226 does not extend to the interface between the attachment segment 222 of the upper segment 122 and the attachment segment 224 of the lower segment 124. In some example embodiments, the lower segment 124 includes a bump 230 protruding out from an edge of the wing segment 204 of the lower segment 124 toward an edge of the wing segment 202 of the upper segment 122. The bump 230 is designed to make contact with the edge of the wing segment 202 of the upper segment 122 to help with the structural integrity retention structure 100 when the pawl 104 is supporting the weight of a recessed lighting fixture. For example, the bump 230 may transfer pressure from lower segment 124 to the upper segment 122. The pawl 104 also includes ribs 232 to provide additional structural integrity for the pawl 104 when the pawl 104 is supporting the weight of a recessed lighting fixture. In some alternative embodiments, the bump 230 and/or one or more of the ribs 232 may be omitted.

In some example embodiments, the pawl 104 may be formed integrally as a single piece with the upper segment 122 and the lower segment 124 coupled by the bridge segment 206. To illustrate, the pawl 104 may be formed using injection molding. For example, the pawl 104 may be molded as shown in FIG. 2C, and the upper segment 122 and the lower segment 124 may be pushed together such that the bump 230 is in contact with the edge of the wing segment 202 of the upper segment 122 (as shown in FIG. 2B), the attachment segments 222, 224 are in contact at the interface 228 (shown in FIG. 2A), and the gap 226 exists between the wing segments 202, 204. In some alternative embodiments, the pawl 104 may be molded as shown in FIG. 2D, and the upper segment 122 and the lower segment 124 may be pushed together such that the bump 230 is in contact with the edge of the wing segment 202 of the upper segment 122 (as shown in FIG. 2B), the attachment segments 222, 224 are in contact at the interface 228 (shown in FIG. 2A), and the gap 226 exists between the wing segments 202, 204.

In some example embodiments, the pawl 104 may be made from plastic, die casted metal. Alternatively, the pawl 104 may be made from other material such as sheet metal. The die casted metal may be, for example zinc, magnesium, or aluminum. The sheet metal may be steel or aluminum. In some example embodiments, the score lines 214, 216 may be formed during the process used to make the pawl 104. Alternatively, the score lines 214, 216 may be made afterwards by, for example, cutting or carving out the score lines from the wing segment 202 of the upper wing segment 122.

In some example embodiments, the wing segment 202 of the upper segment 122 and/or the wing segment 204 of the lower segment 124 may have shapes other than shown in FIGS. 2A-2D. For example, the wing segments 202, 204 may each be curved. Further, in some alternative embodiments, the pawl 104 may have fewer or more ribs 232 than shown in FIG. 2B. Further, in some alternative embodiments, the lower segment 204 may have more than one bump 230. Alternatively, the bump 230 may be omitted, or one or more bumps may extend out from an edge of the upper segment 202 toward the lower segment 204 instead of or in addition to the bump 230. Further, in some alternative embodiments, the bridge segment 206 may have shapes other than shown in FIGS. 2A-2D and may have a different location than shown in FIGS. 2A-2D.

Figure 3A:
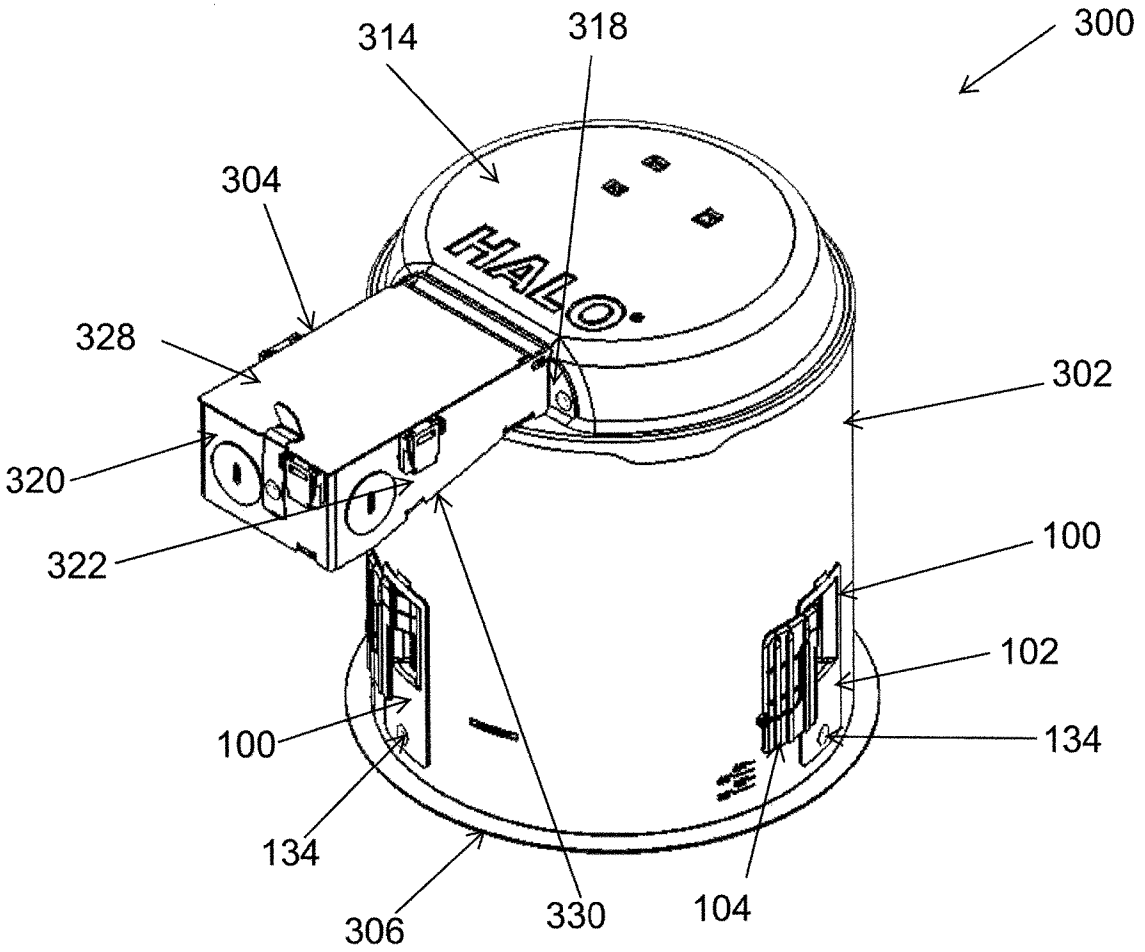
FIGS. 3A-3C illustrate views of a lighting structure including the retention structure of FIGS. 1A-1C according to an example embodiment.
Figure 3B:
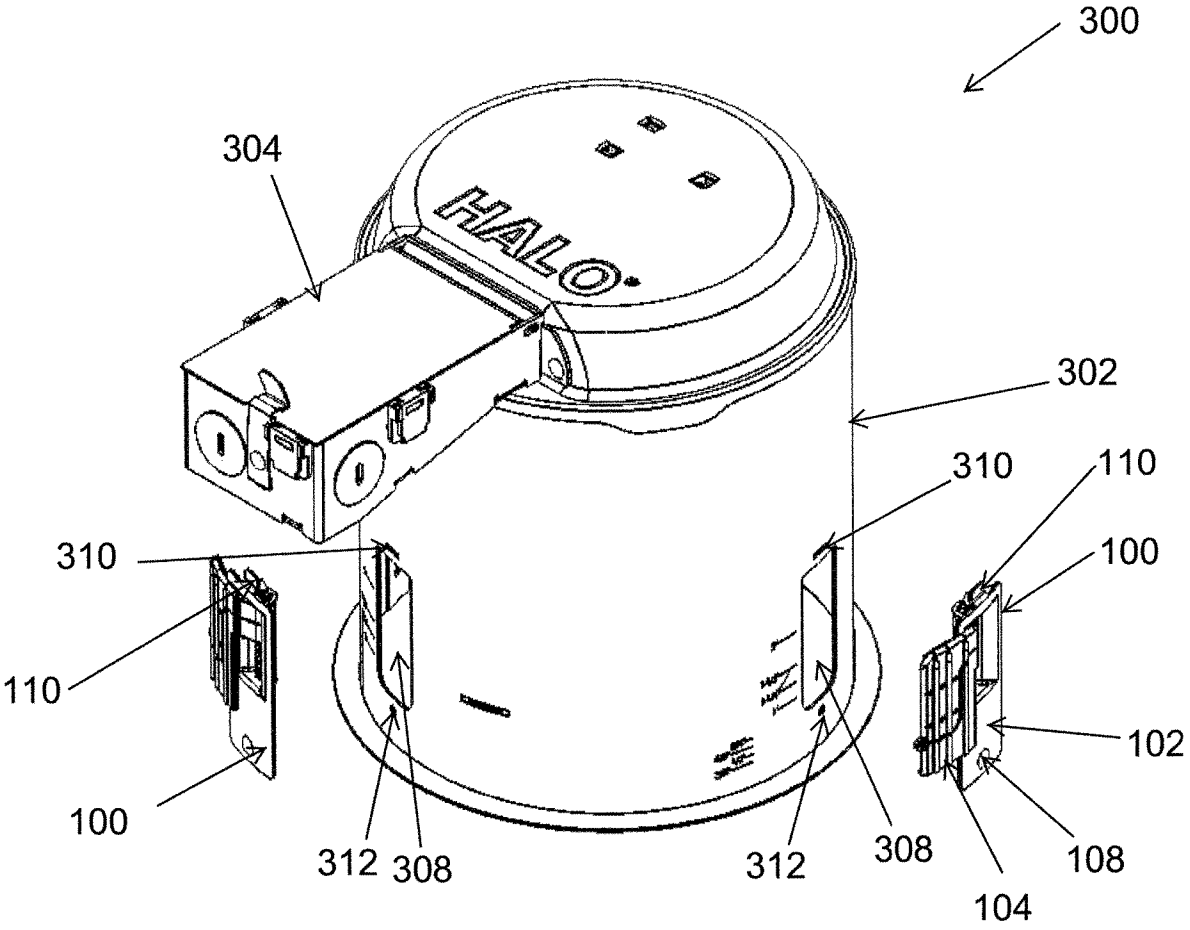
Figure 3C:
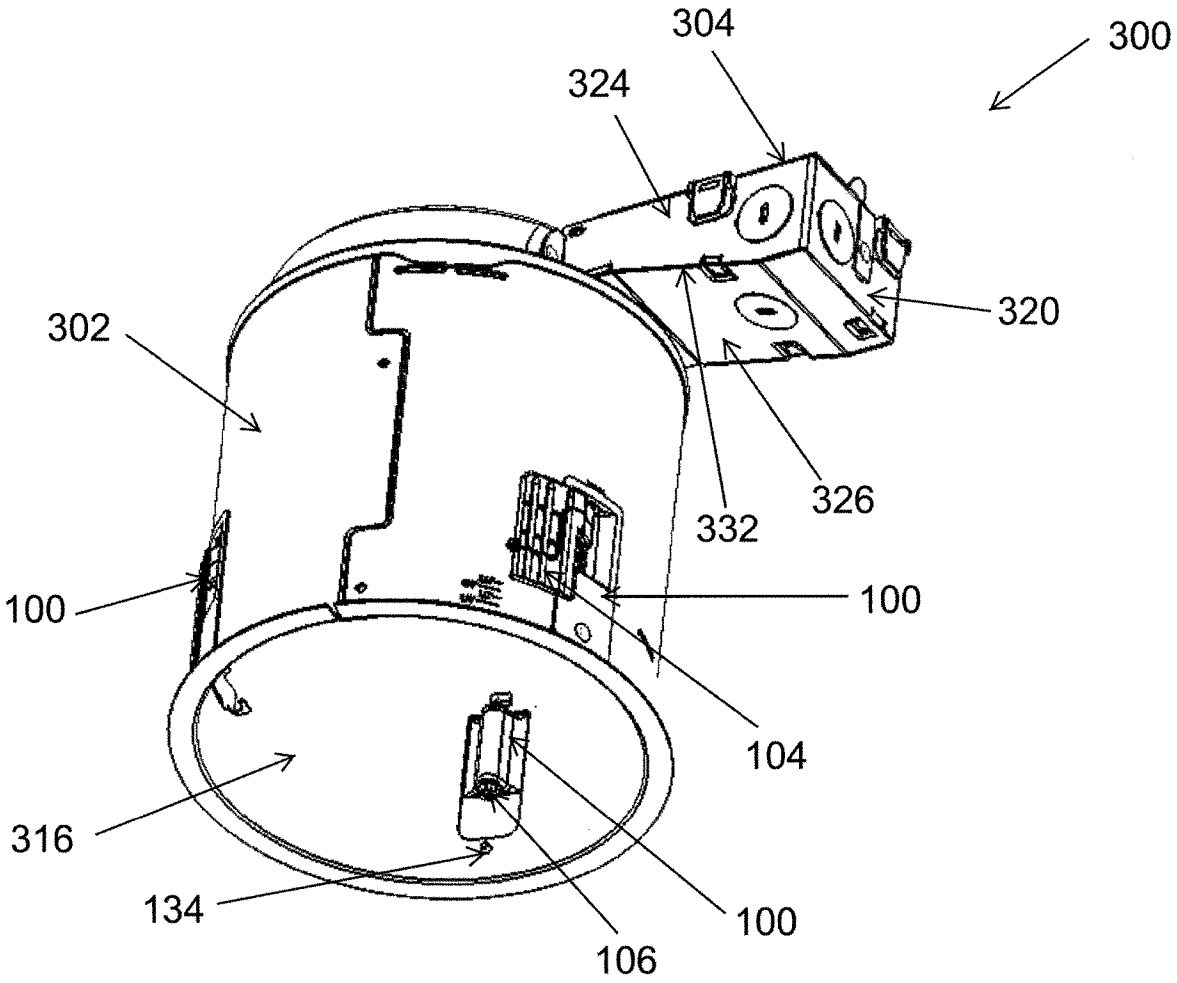

FIGS. 3A-3C illustrate views of a lighting structure 300 including the retention structure 100 of FIGS. 1A-1C according to an example embodiment. The lighting structure 300 includes a lighting fixture housing 302 and one or more of the retention structure 100. For example, the lighting structure 300 may include three of the retention structure 100. In some example embodiments, the lighting structure 300 also includes a junction box 304 for housing wire connectors and other electrical components. In some example embodiments, the junction box 304 may be attached to the housing 302 without the use of an arm or another structure that extends between the housing 302 and the junction box 304. For example, the junction box 304 may be fixedly attached to a housing top 314 of the housing 302. To illustrate, the junction box 304 may be attached to an attachment area 318 of the housing top 314 that may be substantially flat.

In some example embodiments, the junction box 304 includes a back wall 320, side walls 322, 324, a bottom wall 326, and a top wall 328. The back wall 320 is distal from the housing 302 such that the side walls 322, 324, the bottom wall 326, and the top wall 328 extend from the back wall 320 to the housing top 314 of the housing 302. The side walls 322, 324 also extend between the bottom wall 326 and the top wall 328. As illustrated in FIGS. 3A-3C, the junction box 304 may be tapered as the junction box 304 extends from the back wall 320 toward the housing top 314. To illustrate, a bottom edge 330 of the side wall 322, a bottom edge 332 of the side wall 324, and the bottom wall 326, which is attached to the side walls 322, 324 at the bottom edges 330, 332, may be slanted angularly upward as the side walls 322, 324 and the bottom wall 326 extend from the back wall 320 toward the housing 302. In some example embodiments, the tapered shape of the junction box 304 enables the housing 302 to be installed behind a ceiling that is relatively thick (e.g., 2 inches). In some alternative embodiments, the junction box 304 may have other shapes, may be attached to the housing 302 at a different location of the housing 302, may be attached to an arm that is attached to the housing 302, or may be omitted. The housing 302 may be made from plastic or metal. For example, the housing 302 may be made using injection molding process. In some example embodiments, the housing 302 may be made from sheet metal such as aluminum, steel, or other suitable metal.

In some example embodiments, the housing 302 may include a lip 306 that is designed to abut against a structure such as a ceiling when the lighting structure 300 is recessed behind a ceiling. For example, the lip 306 may be integrally formed with the rest of the housing 302. Alternatively, the lip 306 may be part of a band (e.g., a band 1010 of FIG. 10) that is partially inserted inside the housing 302.

In some example embodiments, the housing 302 may also include one or more windows 308. For example, each window 308 may be sized such that a portion of the retention structure 100 is positioned in the window 308. To illustrate, the screw 106 is accessible from within the housing 302 through an opening 316 of the housing 302 (as more clearly shown in FIG. 3C) while the pawl 104 along with portions of the attachment structure 102 are on the outside of the housing 302. For example, the pawl 104 may be positioned against the outer surface of the housing 302 (as shown in FIGS. 3A and 3B).

In some example embodiments, the housing 302 also includes a tab slot 310 and a fastener hole 312. The attachment tab 110 of the attachment structure 102 is inserted into the tab slot 310 of the housing 302 to attach the retention structure 100 to the housing 302. The fastener 134 (shown in FIG. 1C), which may be a rivet, is inserted in the holes 108, 312 to further secure the retention structure 100 to the housing 302. In some example embodiments, using the attachment tab 110 instead of a fastener at the top end of the attachment structure 102 may result in a faster installation of the lighting structure 300.

In some alternative embodiments, the retention structure 100 may be attached to the housing 302 using means others than or in combination with one or both of the fastener 134 and the attachment tab 110. For example, the tab slot 310 and the hole 308 may be omitted from the housing 302, and the retention structure 100 may instead be soldered or welded to the housing 302. Alternatively, another fastener along with corresponding holes may be used instead of the attachment tab 110 and the tab slot 310 to attach the retention structure 100 to the housing 302. In some alternative embodiments, the attachment tab 110 may be at the bottom end of the attachment structure 102 and the hole 108 may be at the top end of the attachment structure 102. In yet other alternative embodiments, the attachment structure 102 of each retention structure 100 may be coupled to a band (e.g., a band 1010 shown in FIG. 10) on the inside of the housing 302. For example, the lip 306 may be a portion of the band that is partially positioned within the housing 302, and a fastener, such as the fastener 134 of FIG. 1C, may be used to attach the attachment structure 102 to the housing 302.

After the retention structure 100 is attached to the housing 302 as described below, the pawl 104 may be rotated out by rotating the screw 106 of the retention structure 100 as described below. For example, the pawl 104 of each retention structure 100 may be rotated out away from the surface of the housing 302 until the pawl 104 is prevented from further rotation. In general, the pawl 104 of each retention structure 100 is in the collapsed position shown in FIGS. 3A-3C when the lighting structure 300 is inserted through an opening of a ceiling.

Figure 4:
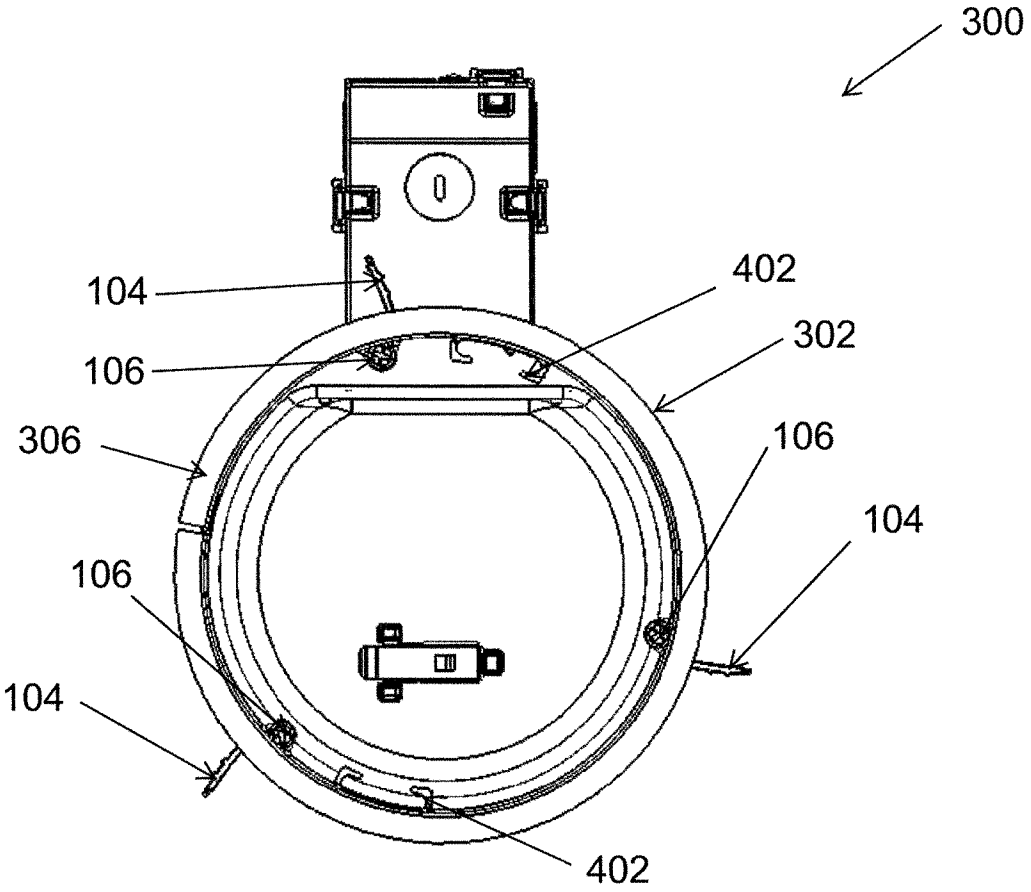
FIG. 4 illustrates a bottom view of the lighting structure of FIGS. 3A-3C with the pawl of the retention structures in a rotated out position according to an example embodiment.

FIG. 4 illustrates a bottom view of the lighting structure of FIGS. 3A-3C with the pawl 104 of each retention structures 100 in a rotated out position according to an example embodiment. As described above, the pawl 104 is rotatable along with the screw 106. For example, the pawl 104 may be rotatable between a first rotational position (e.g., a collapsed rotational position) shown in FIGS. 3A-3C and a second rotational position (e.g., an extended rotational position) shown in FIG. 4. To illustrate, the pawl 104 may rotate in response to the screw 106 being rotated from within the housing 302. For example, after the lighting structure 300 is recessed behind a ceiling, the screw 106 may be rotated using a tool such as a screw driver to rotate the pawl 104 out to the extended rotation position shown in FIG. 4.

In some example embodiments, the screw 106 may also be rotated to rotate the pawl 104 out to a rotational position, for example, between the collapsed rotational position shown in FIG. 3A and the extended rotational position shown in FIG. 4. Alternatively, the pawl 104 may be rotated further than the extended rotational position shown in FIG. 4 relative to the collapsed rotational position shown in FIGS. 3A-3C. In general, the pawl 104 may rotate along with the screw 106 until a structure such as the attachment structure 102 (e.g., the wall section 112 shown in FIG. 1A) prevents the pawl 104 from rotating further. As described below, the pawl 104 may move axially along the screw 106 once the pawl 104 is prevented from further rotation relative to the collapsed rotational position. To retain the lighting structure 300 behind a structure such a ceiling, the pawl 104 is typically rotated out after the lighting structure 300 is inserted through an opening with the pawl 104 of each retention structure 100 in the collapsed position shown in FIG. 3A. After each pawl 104 is rotated to the extended rotational position, the retention structure 100 is designed to retain the lighting structure 300 including the housing 302 in a recessed position behind the structure such as the ceiling.

Figure 2A:
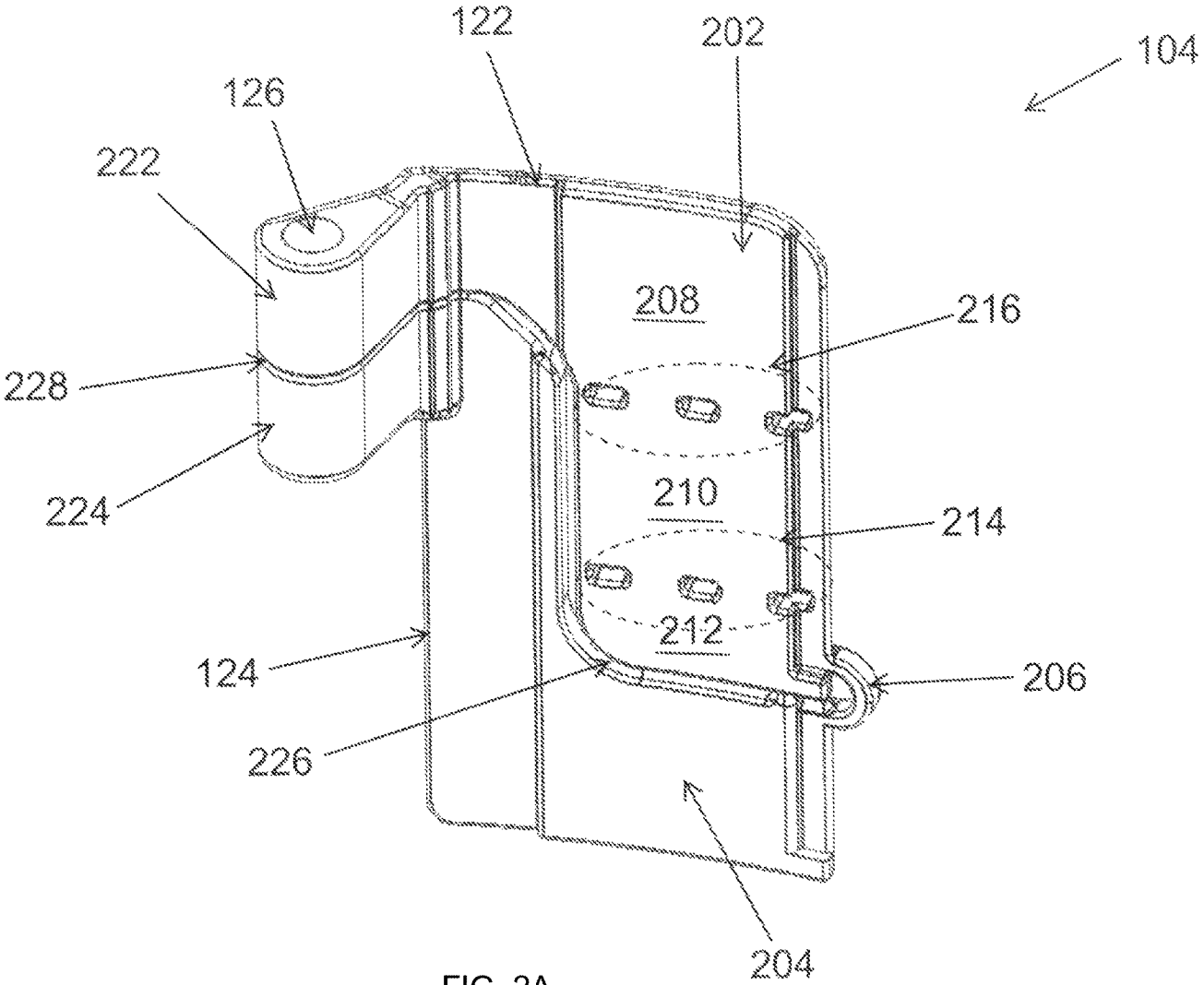
FIGS. 2A-2D illustrate views of a pawl of the retention structure of FIGS. 1A-1C according to an example embodiment.
Figure 2B:
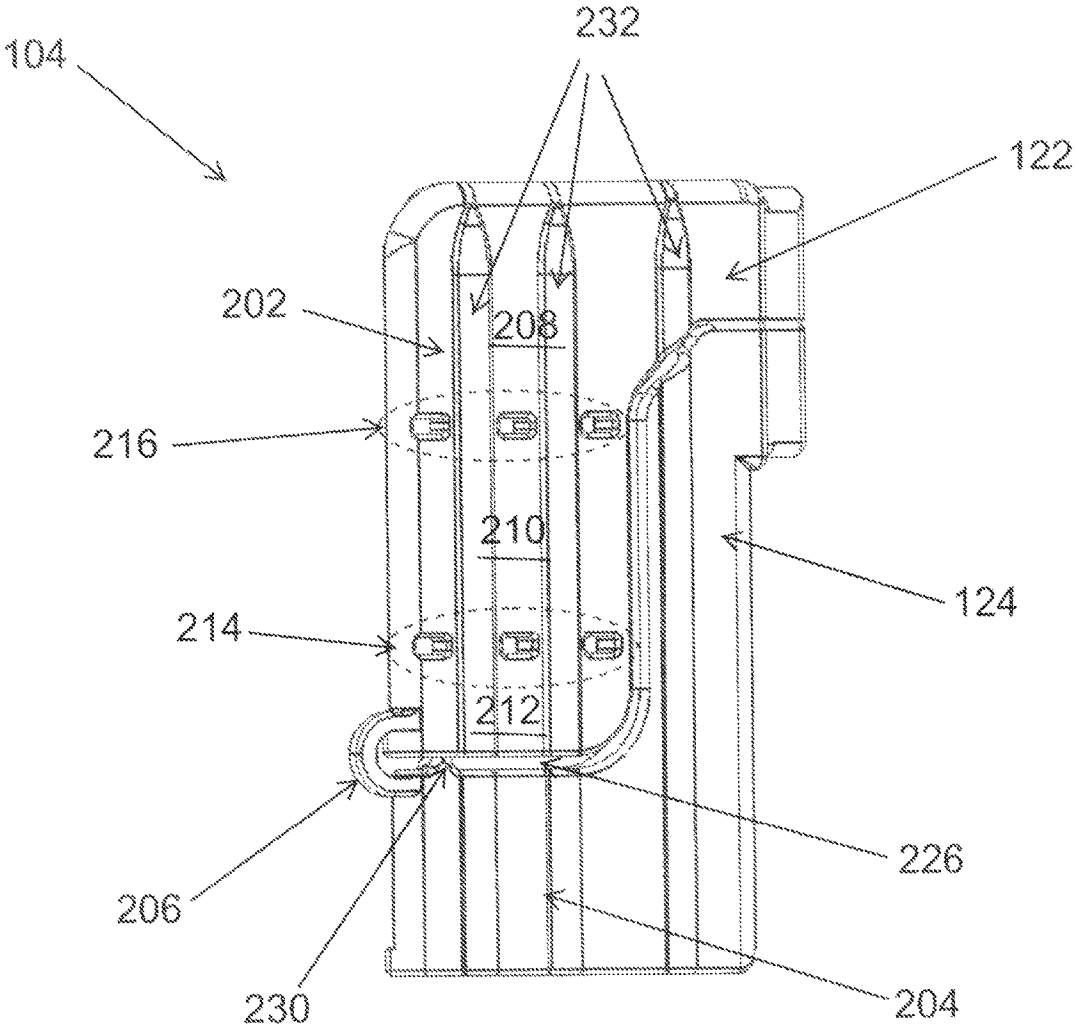
Figure 2C:
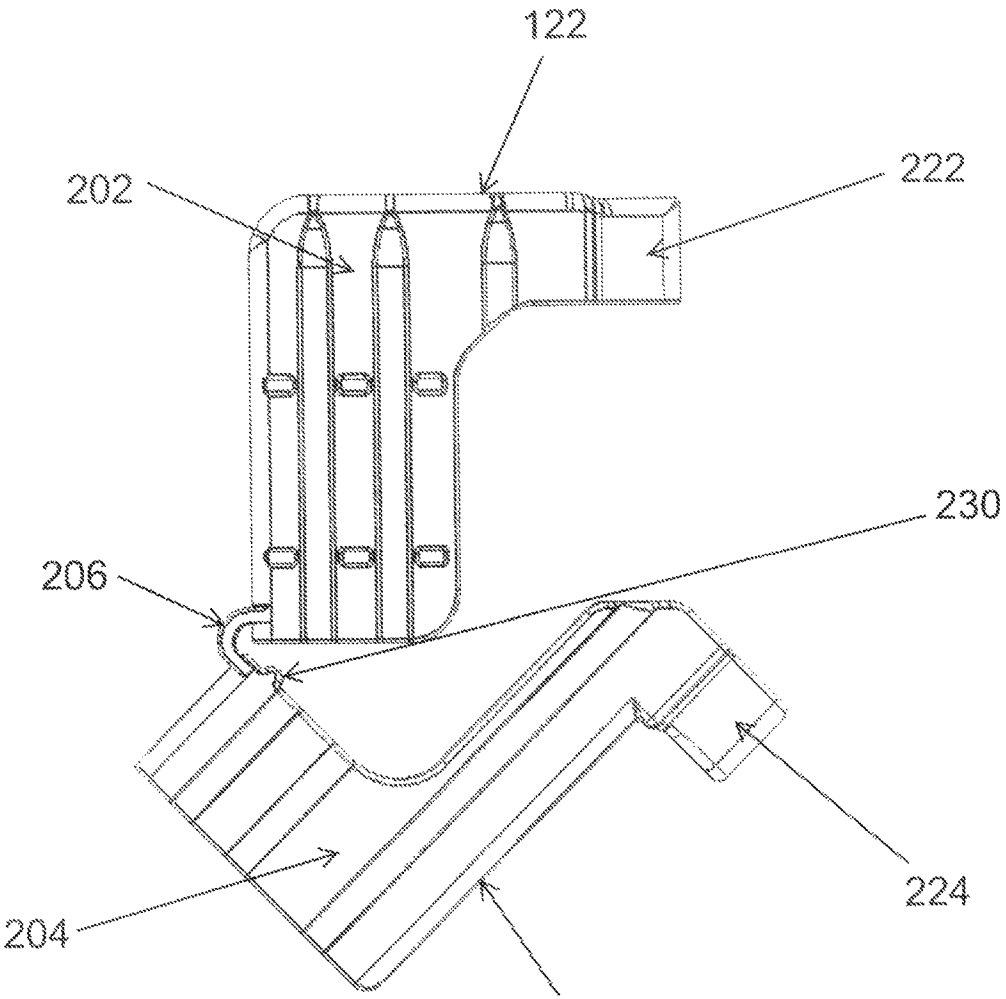
Figure 2D:
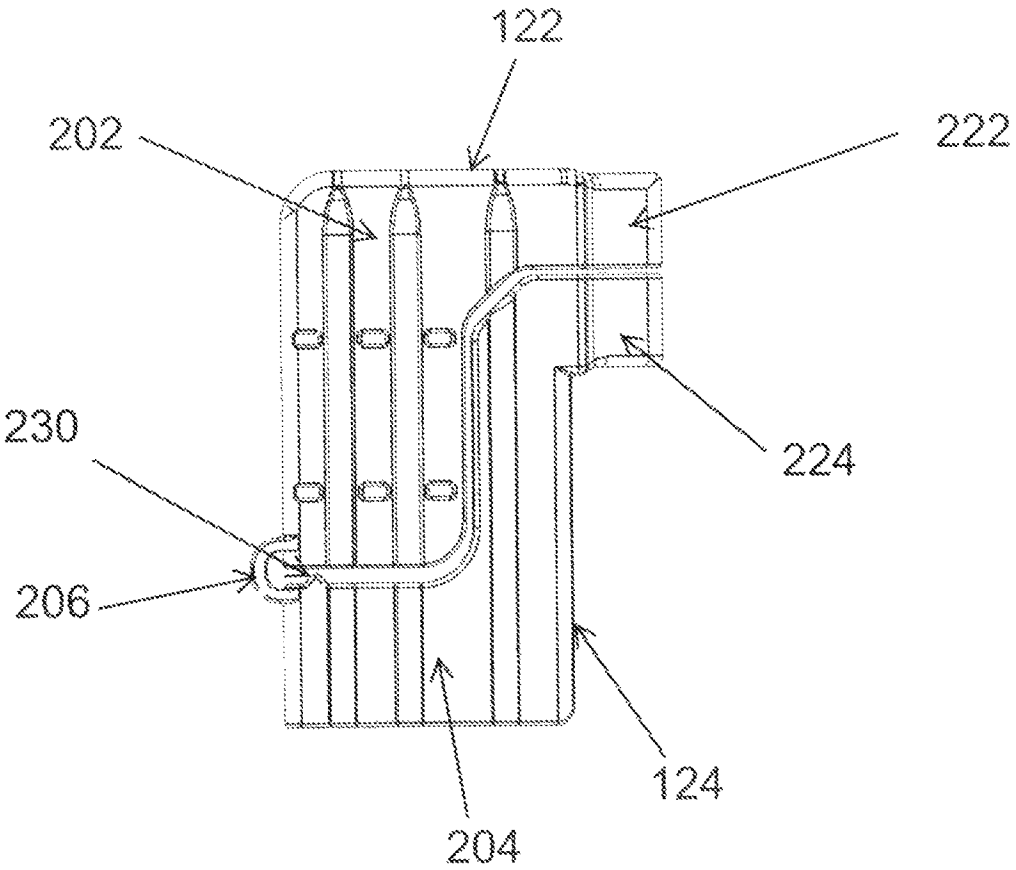

In some example embodiments, the bridge segment 206 shown in FIG. 2A may be severed to accommodate a particular thickness of a ceiling. For example, when the bridge segment 206 is cut, rotating the screw 106 may rotate the upper segment 202 (shown in FIG. 2A) of the pawl 104 without rotating the lower segment 204 (also shown in FIG. 2A) of the pawl 104 significantly or at all. Similarly, the upper segment 202 may be cut along one or both score lines resulting in a rotation of a portion of the upper segment 202 rotating along with the screw 106 while other portions of the pawl 104 do not rotate significantly or at all.

In some example embodiments, the lighting structure 300 may include one or more torsion spring receivers 402. For example, the torsion spring receivers 402 may be used to attach a lighting module (not shown) or a reflector (not shown) to the housing 302 using respective torsion springs. The torsion spring receivers 402 may be integrally formed with the housing 302. Alternatively, the torsion spring receivers 402 may be attached to the housing 302 by means such as soldering, welding, or riveting. The torsion spring receivers 402 may also be attached to a band (e.g., the band 1010 of FIG. 10) that is inserted in the housing 302. After the lighting structure 300 is recessed behind a ceiling by the retention structures 100 as described above, a lighting module or a reflector may be attached to the housing 302 using torsion springs that are attached to the torsion spring receivers 402.

Figure 5A:
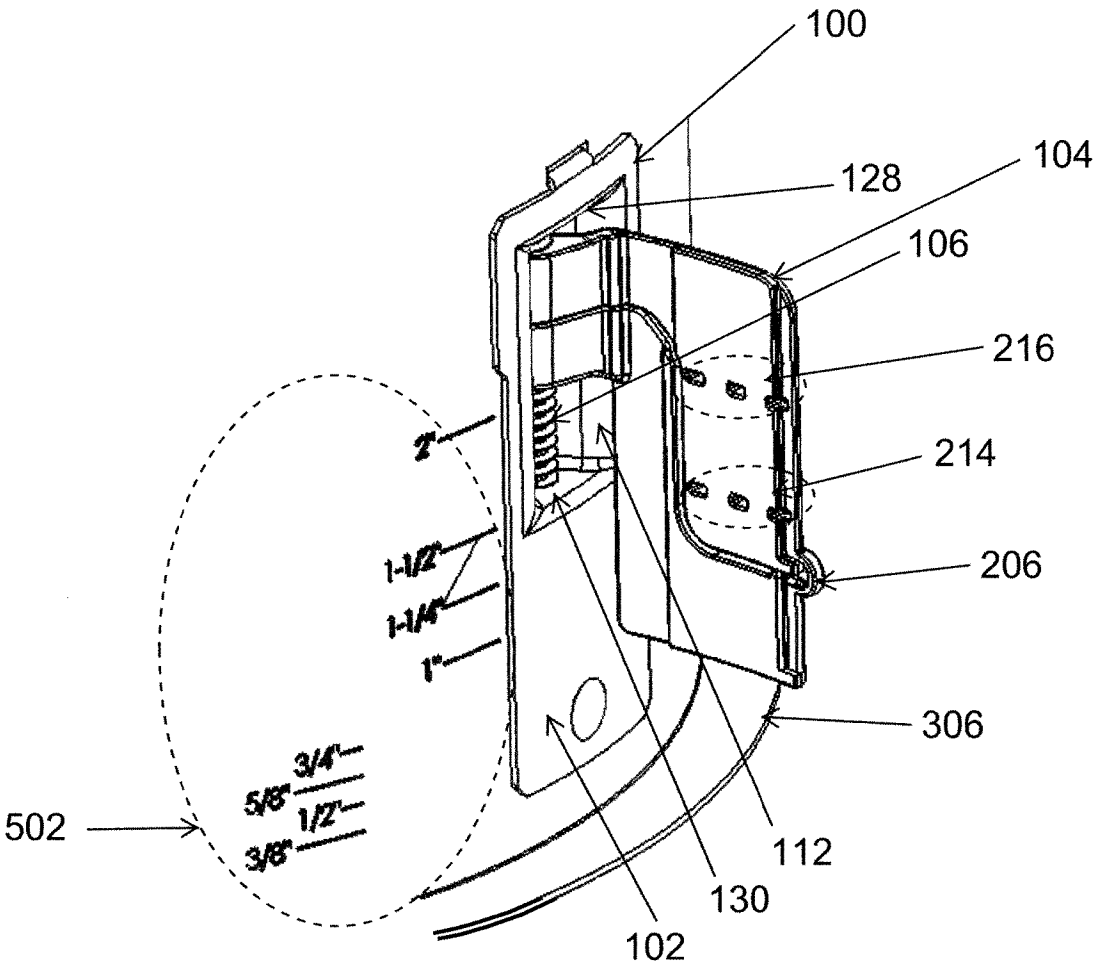
FIGS. 5A and 5B illustrate close-up views of the lighting structure of FIGS. 3A-3C showing the retention structure of FIG. 1 with the pawl rotated out according to an example embodiment.
Figure 5B:
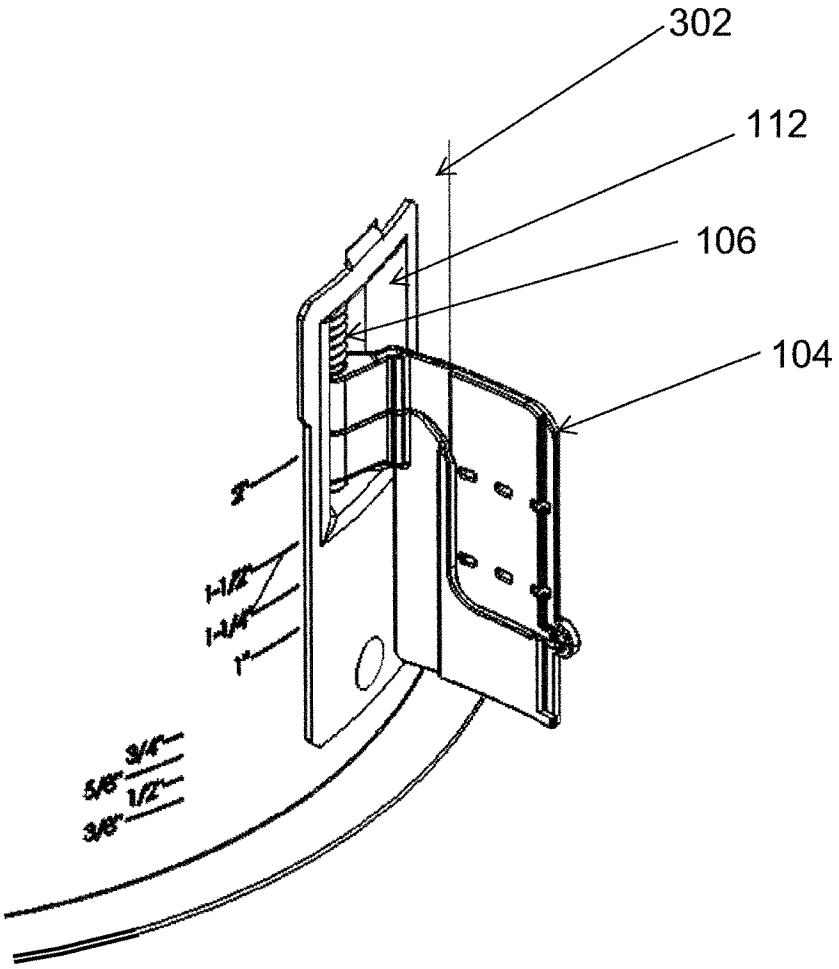

FIGS. 5A and 5B illustrate close-up views of the lighting structure 300 of FIGS. 3A and 3B showing the retention structure 100 of FIG. 1 with the pawl 104 rotated out according to an example embodiment. The retention structure 100 may be adapted to accommodate ceilings of various thickness. As described above, the pawl 104 is rotated by rotating the screw 106. After the pawl 104 is rotated to the extended rotational position shown in FIG. 5A from the collapsed rotational position shown in FIG. 3A, the pawl 104 may be prevented from further rotation in a direction away from the collapsed position shown in FIG. 5A. For example, when the pawl 104 comes in contact with the attachment structure 102 (e.g., at the wall section 112), the attachment structure 102 may prevent the pawl 104 from rotating further in the same direction. In some alternative embodiments, the housing 302 instead of or in addition to the attachment structure 102 may prevent further rotation of the pawl 104 after the pawl 104 is rotated away from the collapsed rotational position shown in FIG. 5A.

As illustrated in FIG. 5A, a portion of the screw 106 that is between the pawl 104 and the bottom wall 130 is longer than the portion of the screw 106 that is between the pawl 104 and the top wall 128. In some example embodiments, after the pawl 104 is in the extended rotational position shown in FIG. 5A, further rotation of the screw 106 in the same direction that resulted in the rotation of the pawl 104 to the extended rotational position may cause the pawl 104 to move axially down along the screw 106. For example, further rotation of the screw 106 may result in the pawl 104 moving axially along the screw 106 to the position of the pawl 104 shown in FIG. 5B. In contrast to FIG. 5A, in FIG. 5B, a portion of the screw 106 that is between the pawl 104 and the bottom wall 130 is smaller than the portion of the screw 106 that is between the pawl 104 and the top wall 128.

Because the pawl 104 can be moved axially to different axial positions along the screw 106, the retention structure 100 may be used with ceilings that have different thicknesses. Further, because the pawl 104 may be cut at the bridge segment 206 and along the score lines 214, 216, the retention structure 100 can be used with ceilings that have a wide range of thicknesses. In some example embodiments, the retention structure 100 may be used with ceilings that range in thickness from approximately 2 inches to approximately 0.375 inches.

Figure 6A:
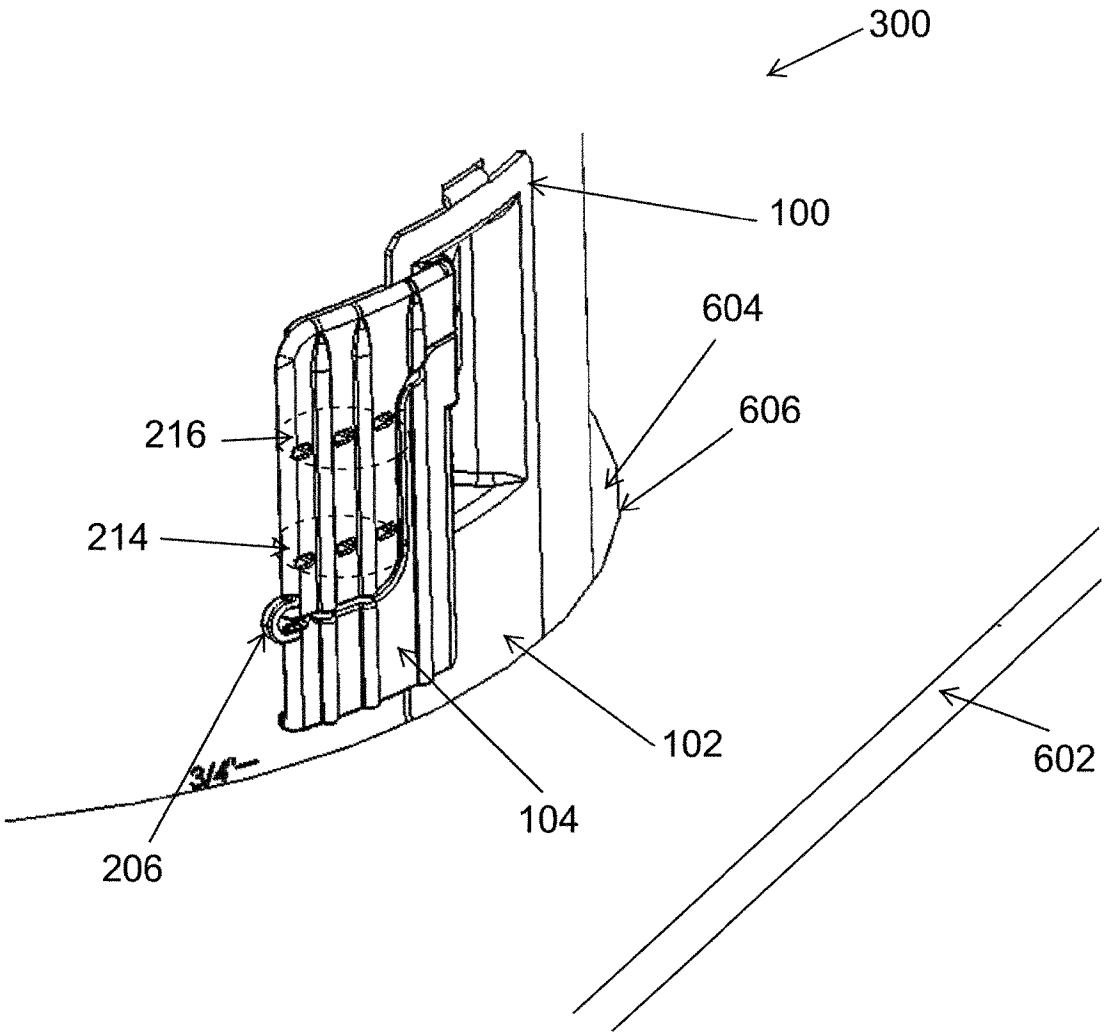
FIGS. 6A-6E illustrate views of the lighting structure of FIGS. 3A-3C recessed in a ceiling according to an example embodiment.
Figure 6B:
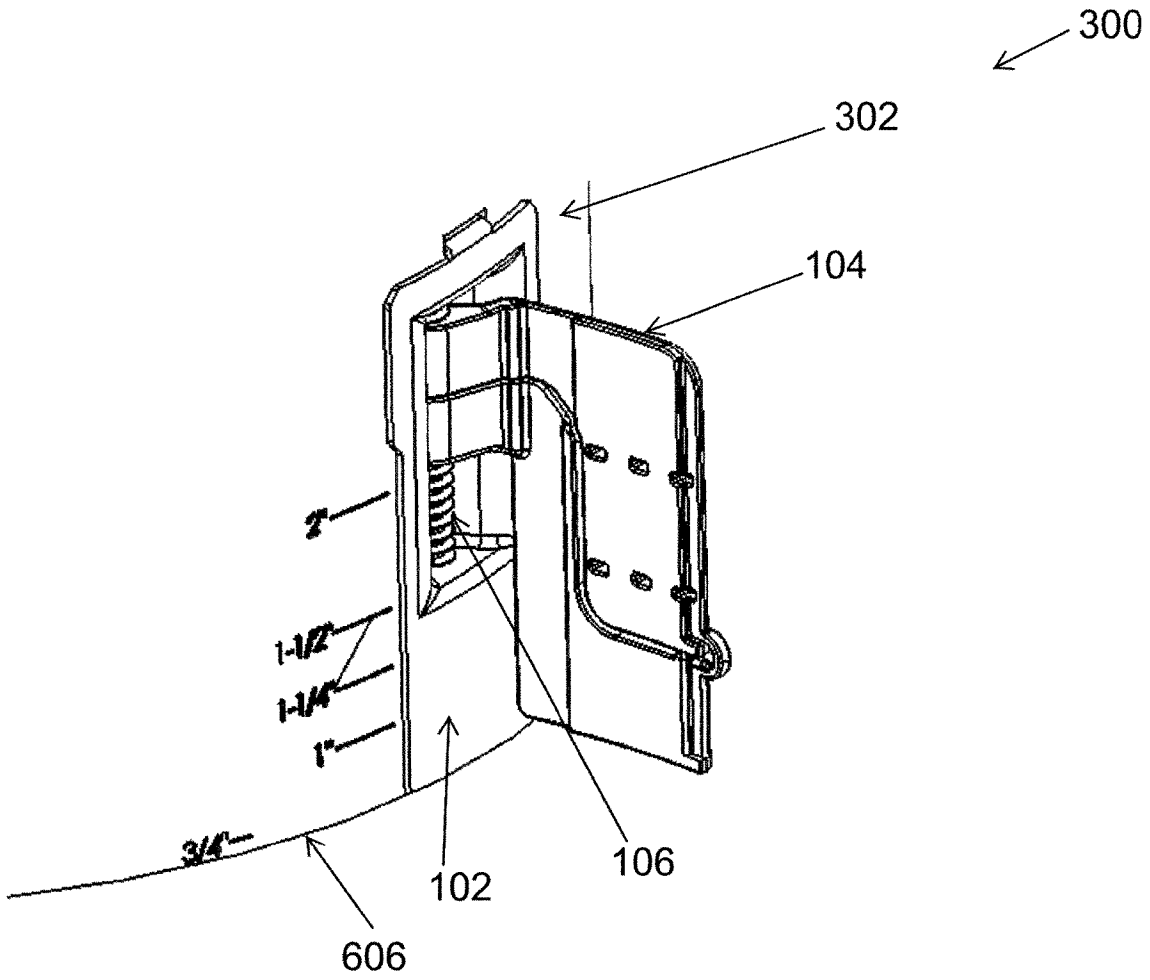
Figure 6C:
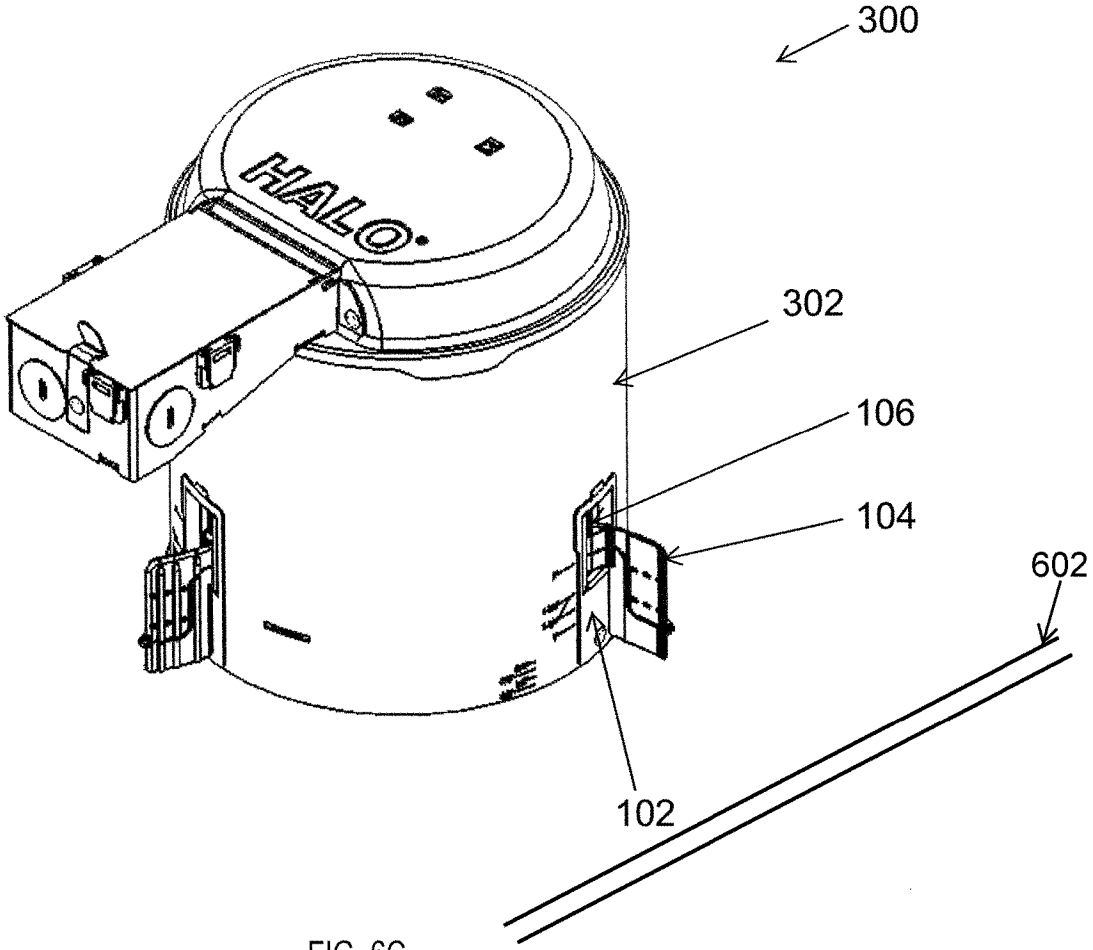
Figure 6D:
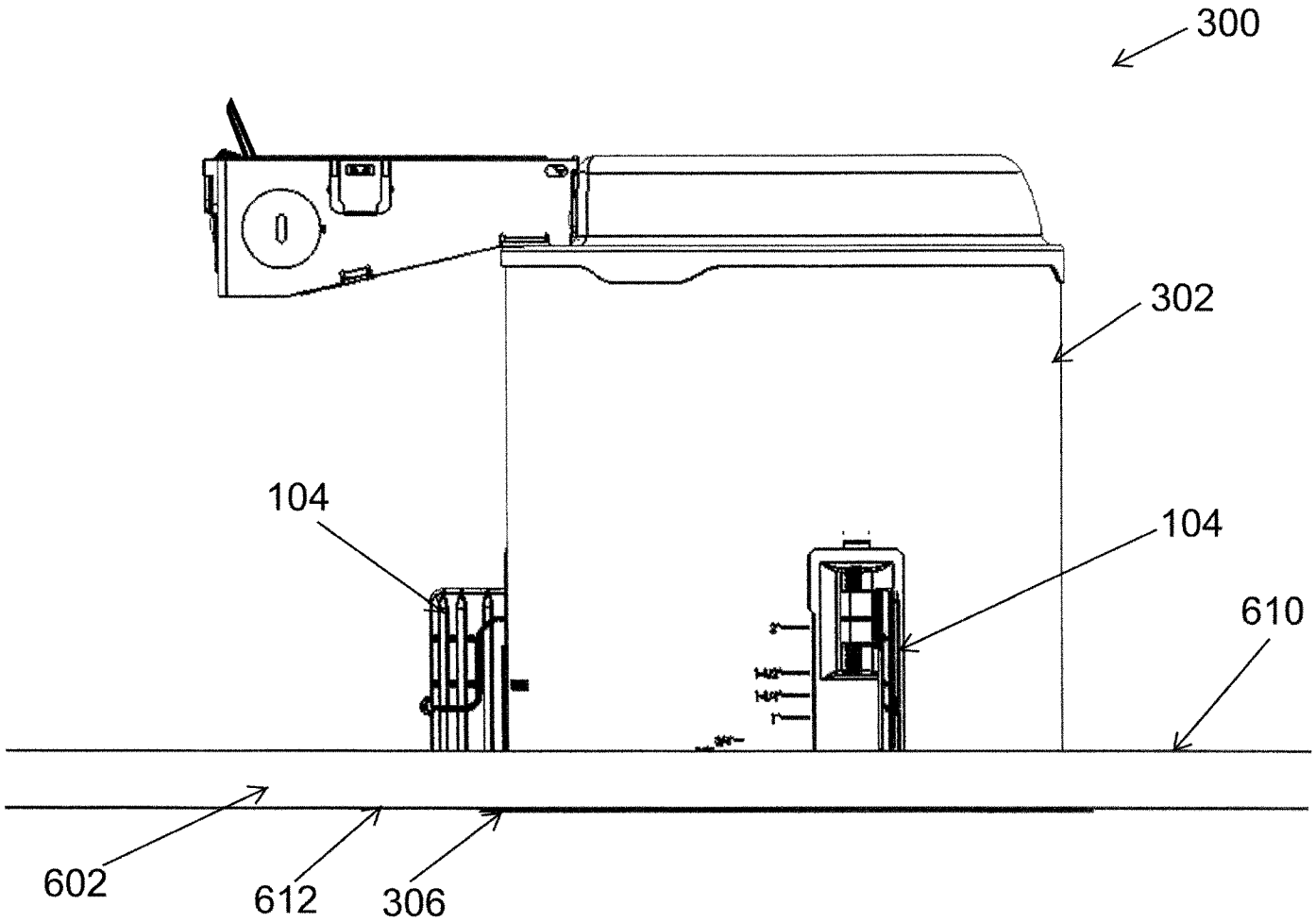
Figure 7A:
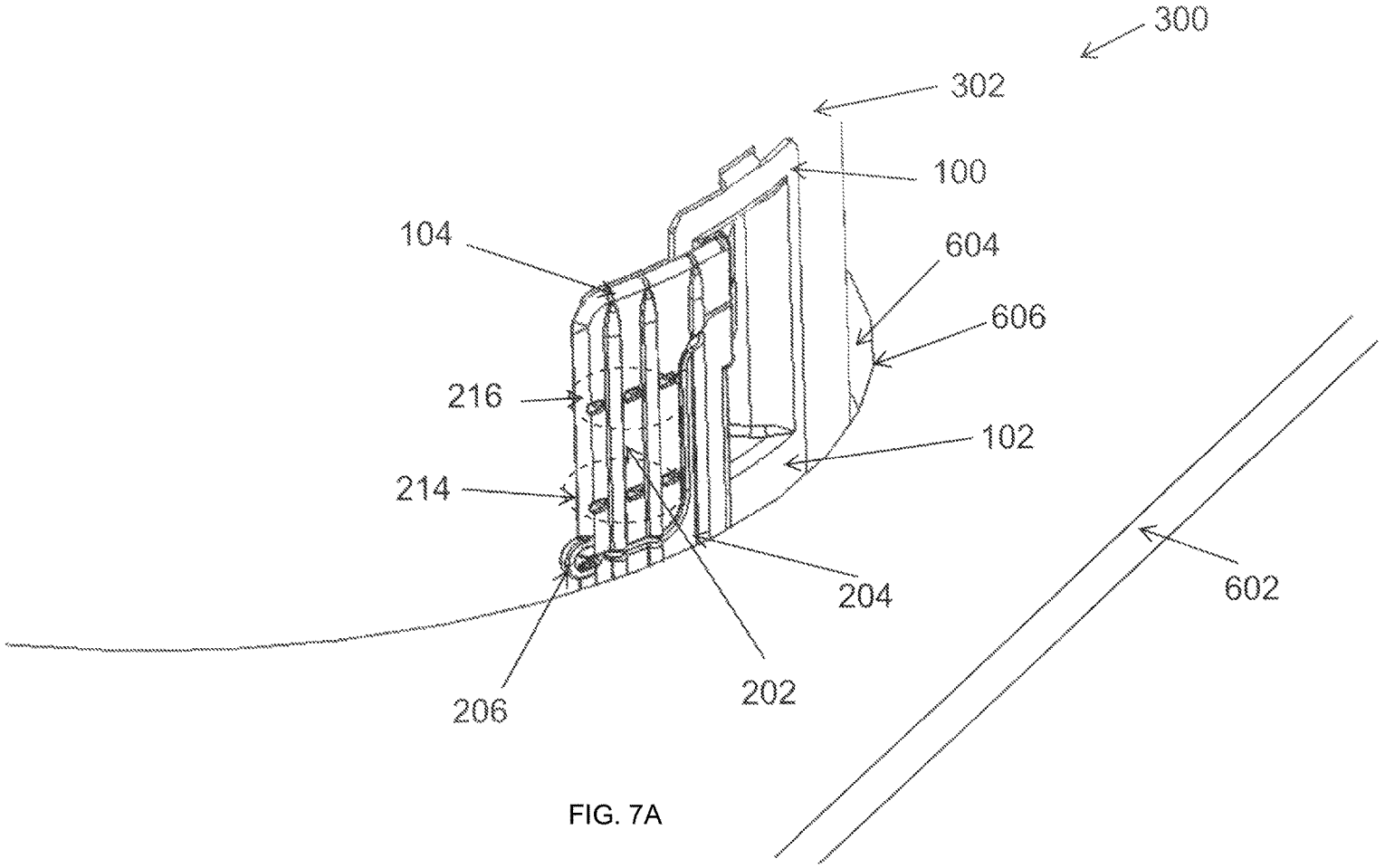
FIGS. 7A and 7B illustrate views of the lighting structure of FIGS. 3A-3C recessed in a ceiling according to another example embodiment.
Figure 7B:
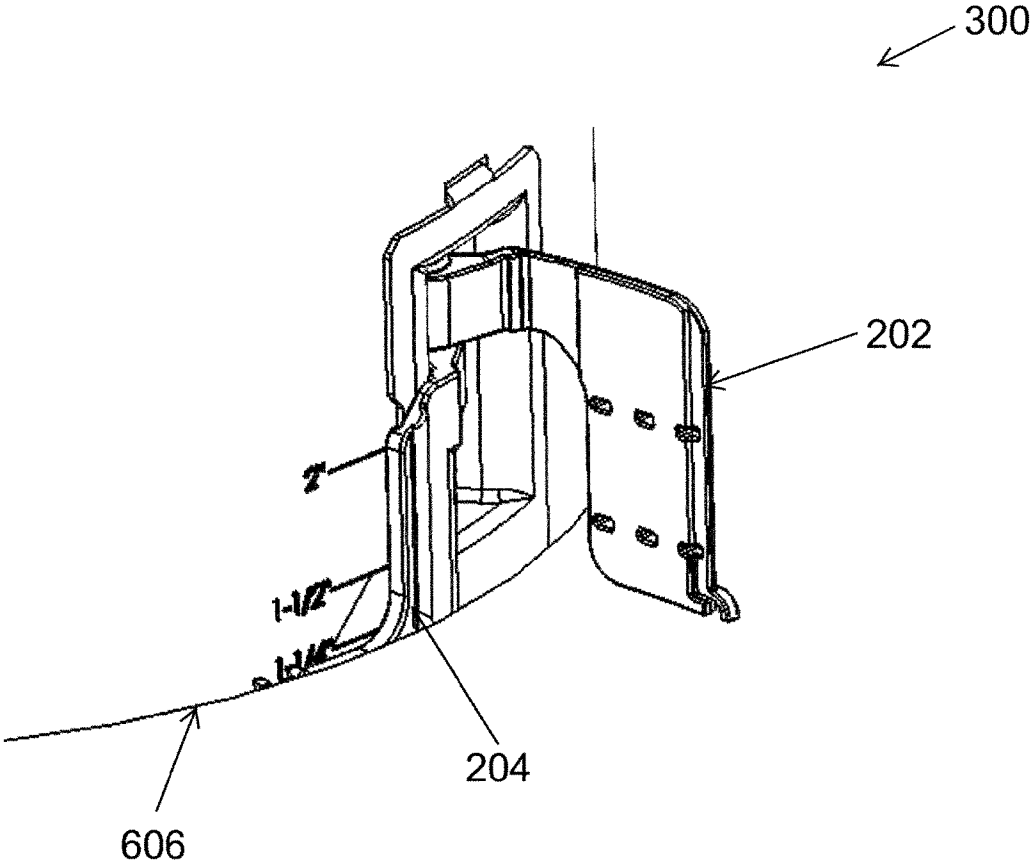

In some example embodiments, the housing 302 includes markings 502 (encircled by the dotted circle for illustrative purposes) that provide a range of ceiling thicknesses that may be used with each configuration of the retention structure 100. To illustrate, one range shown by the markings 502 may correspond to a range of ceiling thicknesses that can be accommodated by the retention structure 102 without cutting the bridge segment 206 and at the score lines 214, 216 of the pawl 104 as shown in FIGS. 6A and 6B. For example, this range may correspond to the thinnest ceilings that can be accommodated by the retention structure 100. Another range shown by the markings 502 may correspond to a range of ceiling thicknesses that can be accommodated by the retention structure 102 after cutting the bridge segment 206 and without cutting the pawl 104 at the score lines 214, 216 of the pawl 104 as shown in FIGS. 7A and 7B.

Figure 8A:
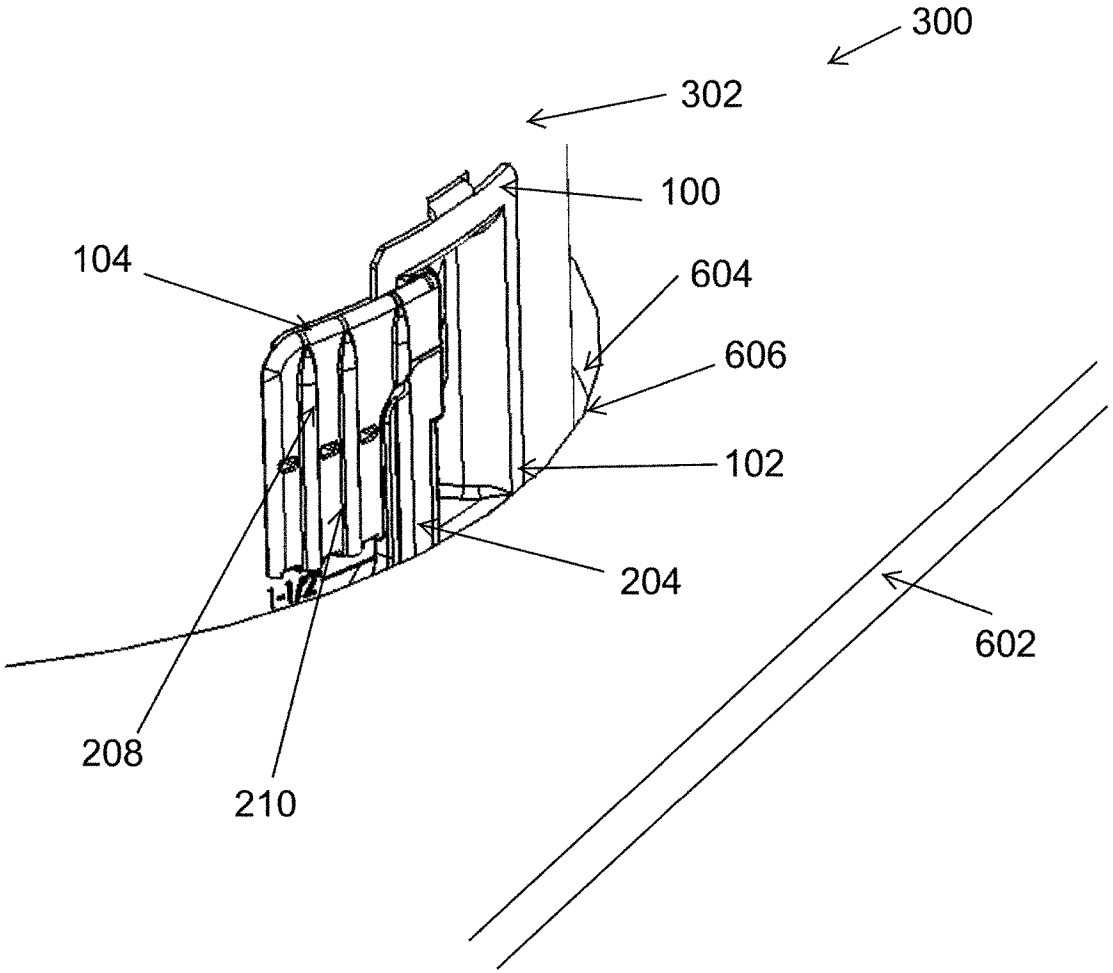
FIGS. 8A and 8B illustrate views of the lighting structure of FIGS. 3A-3C recessed in a ceiling according to another example embodiment.
Figure 8B:
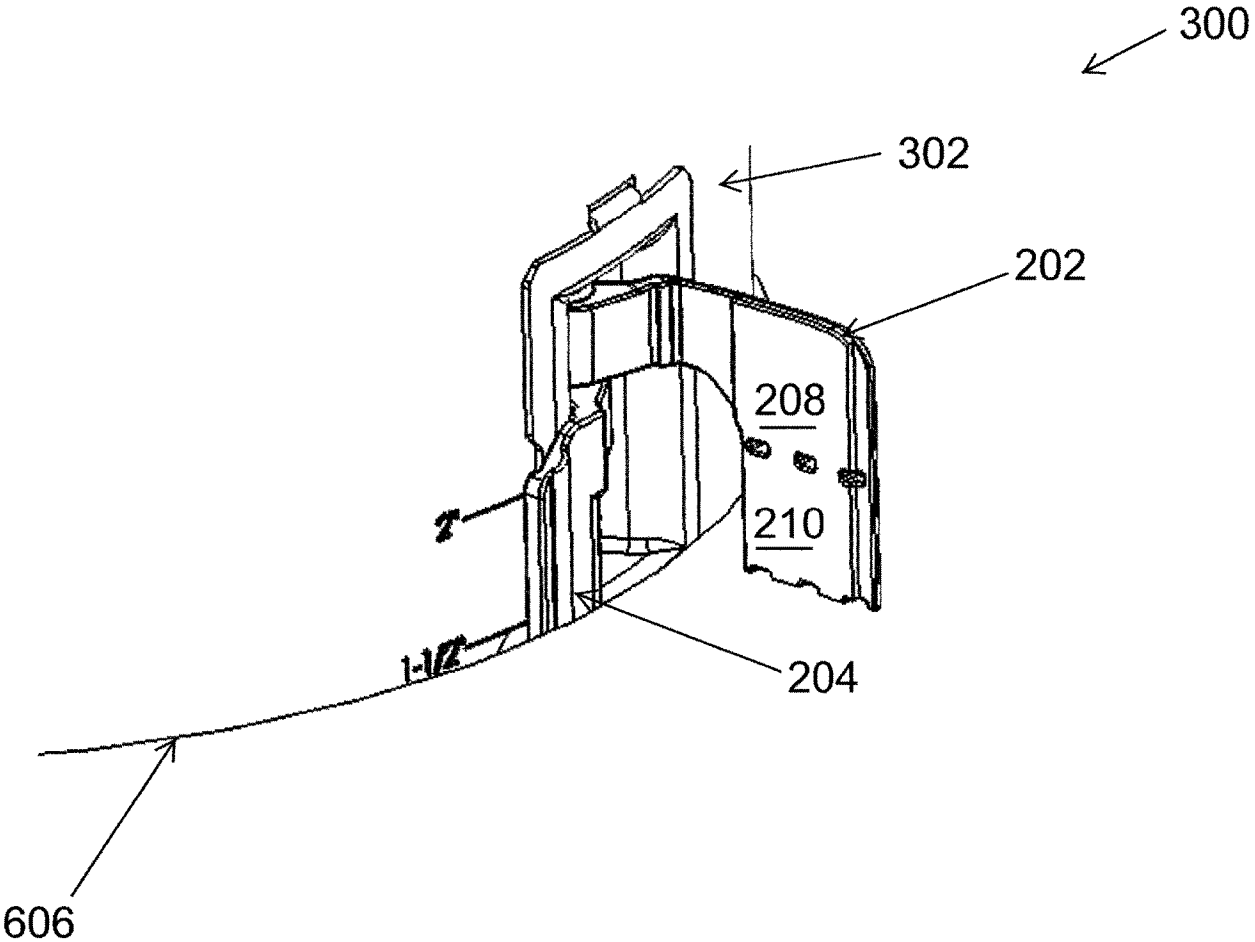
Figure 9A:
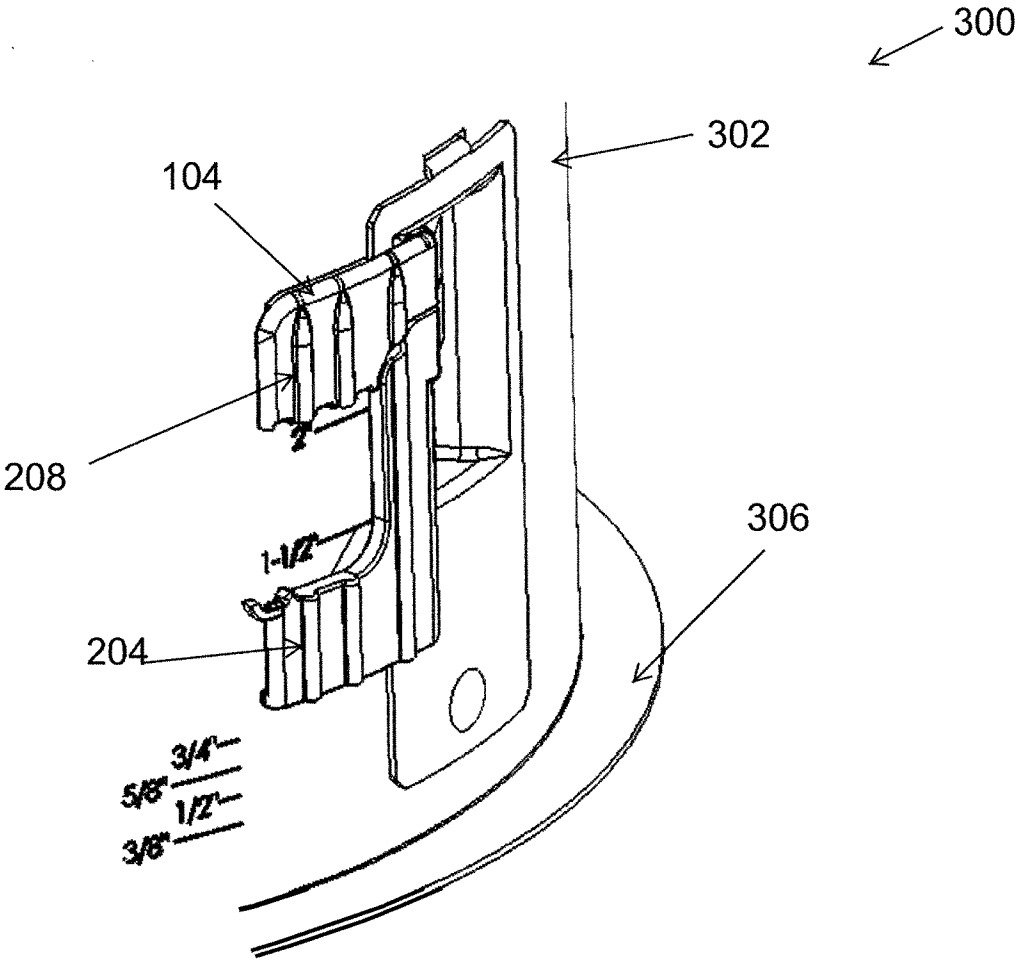
FIG. 9A illustrates a view of the lighting structure of FIGS. 3A-3C prior to being recessed in a ceiling according to another example embodiment.
Figure 9B:
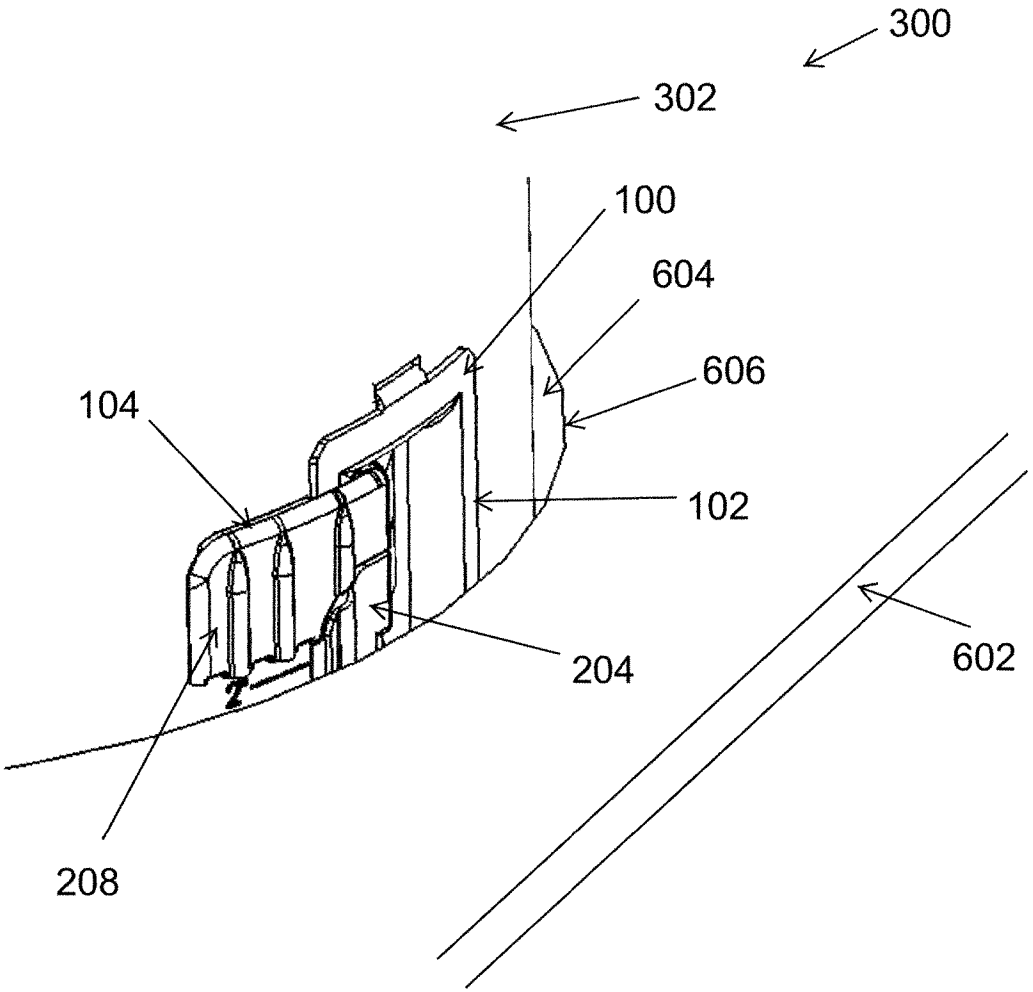
FIGS. 9B and 9C illustrate views of the lighting structure of FIG. 9A recessed in a ceiling according to another example embodiment.
Figure 9C:
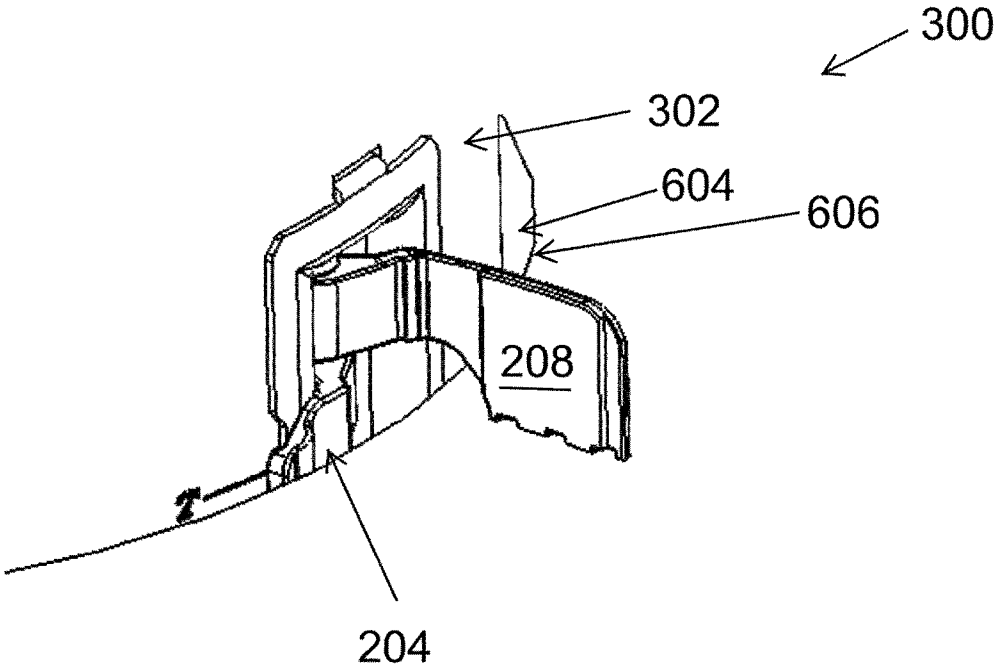

Another range shown by the markings 502 may correspond to a range of ceiling thicknesses that can be accommodated by the retention structure 102 after cutting the bridge segment 206 and the pawl 104 at the score line 214 and without cutting at the score line 216 as shown in FIGS. 8A and 8B. Another range shown by the markings 502 may correspond to a range of ceiling thicknesses that can be accommodated by the retention structure 102 after cutting the bridge segment 206 and the pawl 104 at the score lines 214, 216 of the pawl 104 as shown in FIGS. 9A-9C. For example, this range may correspond to the thickest ceilings that can be accommodated by the retention structure 100. In some example embodiments, the wing segment 202 of the pawl 104 may be cut at locations other than the score lines 214, 216 to accommodate some ceilings.

FIGS. 6A-6E illustrate views of the lighting structure 300 of FIGS. 3A-3C recessed in a ceiling 602 according to an example embodiment. As shown in FIGS. 6A-6D, the lighting structure 300 is inserted through an opening 606 of the ceiling 602. For example, the pawl 104 of the retention structure 100 is in a collapsed rotational position when the lighting structure 300 is inserted through the opening 604 as shown in FIG. 6A. For example, the pawl 104 may be in contact with the housing 302 on one side of the attachment structure 102 of the retention structure 100. As illustrated in FIG. 6A, in some example embodiments, the pawl 104 is positioned above the ceiling 602 and above a perimeter 606 of the opening 604 after the lighting structure 300 is inserted through the opening 604.

As illustrated in FIG. 6B, the pawl 104 is rotated out to an extended rotational position that is away from the collapsed rotational position of the pawl 104 shown in FIG. 6A. As described above, the pawl 104 may be rotated out by rotating the screw 106 from within the housing 302. After the pawl 104 is rotated out as shown in FIG. 6B, the pawl 104 may be lowered axially along the screw 106 to the axial position of the pawl 104 shown in FIG. 6C by further rotating the screw 106. As more clearly shown in FIG. 6D, after the pawl 104 is axially lowered along the screw 106, the lip 306 of the lighting structure 300 may be abutted against a surface 612 of the ceiling 602 facing an area below the ceiling 602, and the pawl 104 may be in contact with the surface 610 of the ceiling 602 facing away from the area below the ceiling 602.

Figure 6E:
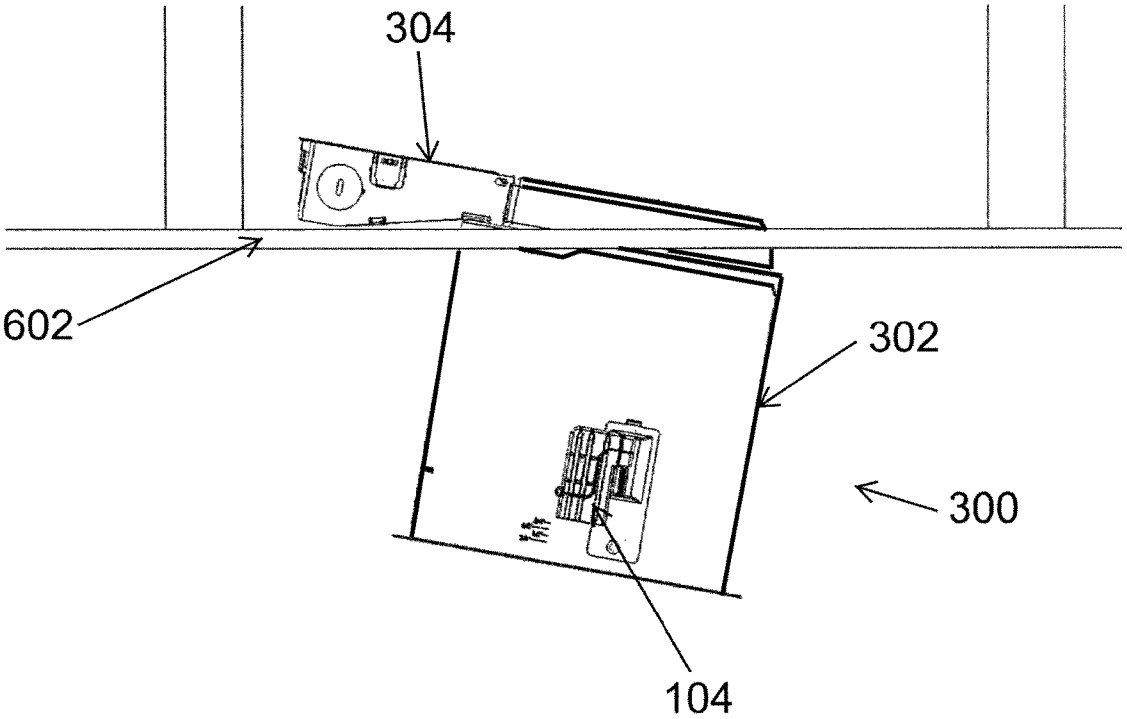

In some example embodiments, to remove the lighting structure 300 from the ceiling 602, the screw 106 may be rotated in an opposite direction. If the screw 106 is initially unable to rotate toward the collapsed rotational position shown in FIG. 6A, the pawl 104 moves axially upward along the screw 106 until the pawl 104 is able to rotate to the collapsed rotational position. After the pawl 104 rotates to the collapsed rotational position shown in FIG. 6A by rotating the screw 106, the lighting structure 300 may be slid out through the opening 604 shown in FIG. 6A. In some example embodiments, FIG. 6E illustrates the lighting structure 300 during installation behind the ceiling 602 through the opening 606 of the ceiling 602. In some alternative embodiments, FIG. 6E illustrates the lighting structure 300 during removal from the ceiling 602 through the opening 606 of the ceiling 602. As illustrated in FIG. 6E, the tapered shape of the junction box 304 enables the lighting structure 300 to be installed behind or removed from the ceiling 602 through the opening 606 that has a diameter that is slightly larger than the diameter of the housing 302. In some example embodiments, the tapered shape of the junction box 304 may enable the housing 302 to be installed behind a ceiling that is relatively thick (e.g., 2 inches).

As described with respect to FIGS. 5A and 5B, in some example embodiments, the markings 502 on the housing 302 may indicate the particular configuration of the retention structure 100 that should be used with the particular ceiling 602. For example, the thickness of the ceiling 602 may be measured and the measured thickness may be used to determine the particular configuration of the retention structure 100 that is suitable for the ceiling 602. For example, if the ceiling 602 is too thick to use the entire pawl 104 without cutting the bridge segment 206, one or more of the configurations of the retention structure 100 shown in FIGS. 7A-9C may be used.

FIGS. 7A and 7B illustrate views of the lighting structure 300 of FIGS. 3A-3C recessed in the ceiling 602 according to another example embodiment. As illustrated in FIG. 7A, the lighting structure 300 is inserted through the opening 604 of the ceiling 602. The retention structure 100 is positioned such that a portion of the wing segment 204 is between the perimeter 606 of the opening 604 and the housing 302. Because the ceiling 602 is too thick to use the pawl 104 as shown in FIG. 6A, in FIGS. 7A and 7B, the bridge segment 206 is severed (e.g., cut with a tool) prior to inserting the lighting structure 300 into the opening 604 of the ceiling 602. For example, the measured thickness of the ceiling 602 and the markings 502 on the housing 302 may be used to determine that the bridge segment 206 should be cut and that the pawl 104 does not need to be cut at the score lines 214, 216. Alternatively, the measured thickness may be compared with the locations of the bridge segment 206 and the score lines 214, 216 relative to the lip 306 (shown in FIG. 6D) of the lighting structure 300 to determine that only the bridge segment 206 needs to be cut.

As illustrated in FIG. 7B, the wing segment 202 is rotated to an extended rotational position away from the position of the wing segment 202 shown in FIG. 7A. For example, the wing segment 202 may be rotated to the position shown in FIG. 7B by rotating the screw 106 shown in FIG. 1A. The screw 106 may be rotated by a person (not shown) from below the ceiling 602. After the wing segment 202 is rotated out, in some example embodiments, the pawl 104 including the wing segment 202 may move axially down along the screw 106 such that the wing segment 202 is in contact with the surface 610 (shown in FIG. 6D) of the ceiling 602. As described above, the pawl 104 including the wing segment 202 may move axially down along the screw 106 after the wing segment 202 is prevented from further rotation away from the position of the wing segment 202 shown in FIG. 7A. For example, the attachment structure 102 or the housing 302 may prevent further rotation of the wing segment 202 in the rotational direction away from the position of the wing segment 202 shown in FIG. 7A.

As illustrated in FIG. 7B, the wing segment 204 of the pawl 104 is prevented from significant rotation by a perimeter wall of the ceiling 602 at the perimeter 606 of the opening 604. In some example embodiments, the lighting structure 300 may be removed from the ceiling 602 in a similar manner described with respect to FIGS. 6A-6E. For example, the screw 106 may be rotated in a rotational direction opposite the rotation direction in which the screw 106 was rotated to rotate the wing segment 202 away from the position of the wing segment 202 shown in FIG. 7A. In some instances, the ceiling 602 may be too thick to use the wing segment 202 as a whole. In such instances, the wing segment 202 may be cut at the score line 214 as shown in FIGS. 8A and 8B.

FIGS. 8A and 8B illustrate views of the lighting structure 300 of FIGS. 3A-3C recessed in the ceiling 602 according to another example embodiment. As illustrated in FIG. 8A, the lighting structure 300 is inserted through the opening 604 of the ceiling 602. The retention structure 100 is positioned such that a portion of the wing segment 204 is between the perimeter 606 of the opening 604 and the housing 302 of the lighting structure 300. Because the ceiling 602 is too thick to use the entire pawl 104 as shown in FIGS. 6A-6E or the entire wing segment 204 as shown in FIGS. 7A and 7B, in FIGS. 8A and 8B, the wing segment 202 is cut at the score line 214 (shown in FIG. 2A). The wing segment 202 may be cut at the score line 214 using any suitable tool. In some example embodiments, the bridge segment 206 (also shown in FIG. 2A) may also be severed. For example, the wing segment 202 is cut at the score line 214 and the bridge segment 206 may be cut prior to inserting the lighting structure 300 into the opening 604 of the ceiling 602.

To illustrate, the measured thickness of the ceiling 602 and the markings 502 on the housing 302 may be used to determine that the wing segment 202 should be cut at the score line 214 to accommodate the particular thickness of the ceiling 602. Alternatively, the measured thickness may be compared with the locations of the bridge segment 206 and the score lines 214, 216 relative to the lip 306 (shown in FIG. 6D) of the lighting structure 300 to determine that the wing segment 202 should be cut at the score line 214. In some alternative embodiments, the wing segment 202 may be cut at the score line 214 but the bridge segment 206 not be cut.

As illustrated in FIG. 8B, the wing segment 202 including the wing sections 208, 210 is rotated to an extended rotational position away from the position of the wing segment 202 shown in FIG. 8A. For example, the wing segment 202 excluding the wing section 212 (shown in FIG. 2A) may be rotated to the position shown in FIG. 8B by rotating the screw 106 shown in FIG. 1A as described above. After the wing segment 202 is rotated out to the rotational position shown in FIG. 8B, in some example embodiments, the wing segment 202 of the pawl 104 may move axially down along the screw 106 such that the wing segment 202 is in contact with the surface 610 (shown in FIG. 6D) of the ceiling 602.

To illustrate, the wing segment 202 may move axially down along the screw 106 after the wing segment 202 is prevented from further rotation away from the position of the wing segment 202 shown in FIG. 8A. For example, the attachment structure 102 or the housing 302 may prevent further rotation of the wing segment 202 (excluding the wing section 212 shown in FIG. 2A, which is prevented from rotating by the perimeter wall of the ceiling 602) in the rotational direction away from the position of the wing segment 202 shown in FIG. 8A.

As illustrated in FIG. 8B, the wing segment 204 of the pawl 104 is prevented from significant rotation by the perimeter wall of the ceiling 602 at the perimeter 606 of the opening 604. In some example embodiments, the lighting structure 300 may be removed from the ceiling 602 in a similar manner described with respect to FIGS. 6A-6E. In some instances, the ceiling 602 may be too thick to use both wing sections 208, 210 of the wing segment 202. In such instances, the wing segment 202 may be cut at the score line 216 as shown in FIGS. 9A-9C.

FIG. 9A illustrates a view of the lighting structure 300 of FIGS. 3A-3C prior to being recessed in the ceiling 602 according to another example embodiment. FIGS. 9B and 9C illustrate views of the lighting structure 300 of FIG. 9A recessed in the ceiling 602 according to another example embodiment. As illustrated in FIG. 9A, the bridge segment 206 (more clearly shown in FIG. 2B prior to being cut) of the pawl 104 is severed. Further, the wing segment 202 is cut at the score lines 214, 216 (also more clearly shown in FIG. 2B prior to being cut). For example, the pawl 104 may be configured in the manner shown in FIG. 9A to accommodate the ceiling 602 shown in FIGS. 9B and 9C that may be relatively thick. In some example embodiments, the ceiling 602 may have a thickness in a range of 1.5 to 2 inches. Alternatively, the configuration of the retention structure 100 shown in FIGS. 9A-9C may accommodate the ceiling 602 with a thickness that is outside the range of the 1.5 to 2 inches.

As illustrated in FIG. 9B, the lighting structure 300 is inserted through the opening 604 of the ceiling 602. The retention structure 100 is positioned such that a portion of the wing segment 204 is between the perimeter 606 of the opening 604 and the housing 302 of the lighting structure 300 and is substantially prevented from rotating. In contrast, the wing section 208 of the pawl 104 is positioned elevationally above the ceiling 602.

As illustrated in FIG. 9C, the wing section 208 of the pawl 104 is rotated to an extended rotational position away from the position of the wing section 208 shown in FIG. 9B. For example, the wing section 208 may be rotated to the position shown in FIG. 9C by rotating the screw 106 shown in FIG. 1A as described above. After the wing section 208 is rotated out to the rotational position shown in FIG. 9C, in some example embodiments, the wing section 208 of the pawl 104 may move axially down along the screw 106 (shown in FIG. 1A) such that the wing section 208 is in contact with the surface 610 (shown in FIG. 6D) of the ceiling 602. To illustrate, the wing section 208 may move axially down along the screw 106 after the wing segment 202 is prevented from further rotation away from the rotational position of the wing section 208 shown in FIG. 9B. For example, the attachment structure 102 or the housing 302 may prevent further rotation of the wing section 208 in the rotational direction away from the position of the wing section 208 shown in FIG. 9B. In some example embodiments, the lighting structure 300 may be removed from the ceiling 602 in a similar manner described with respect to FIGS. 6A-6E.

Figure 10:
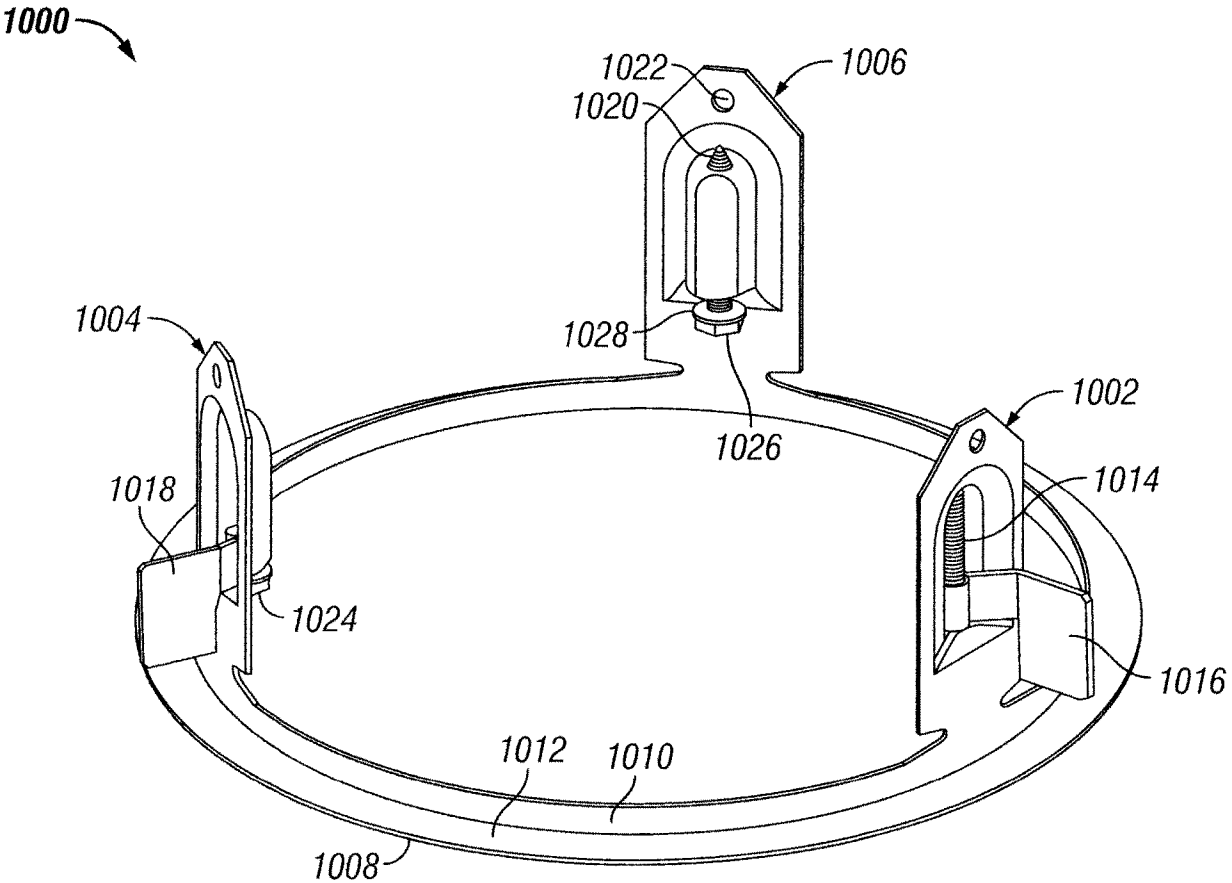
FIG. 10 illustrates a lighting fixture retention structure according to another example embodiment.
Figure 11:
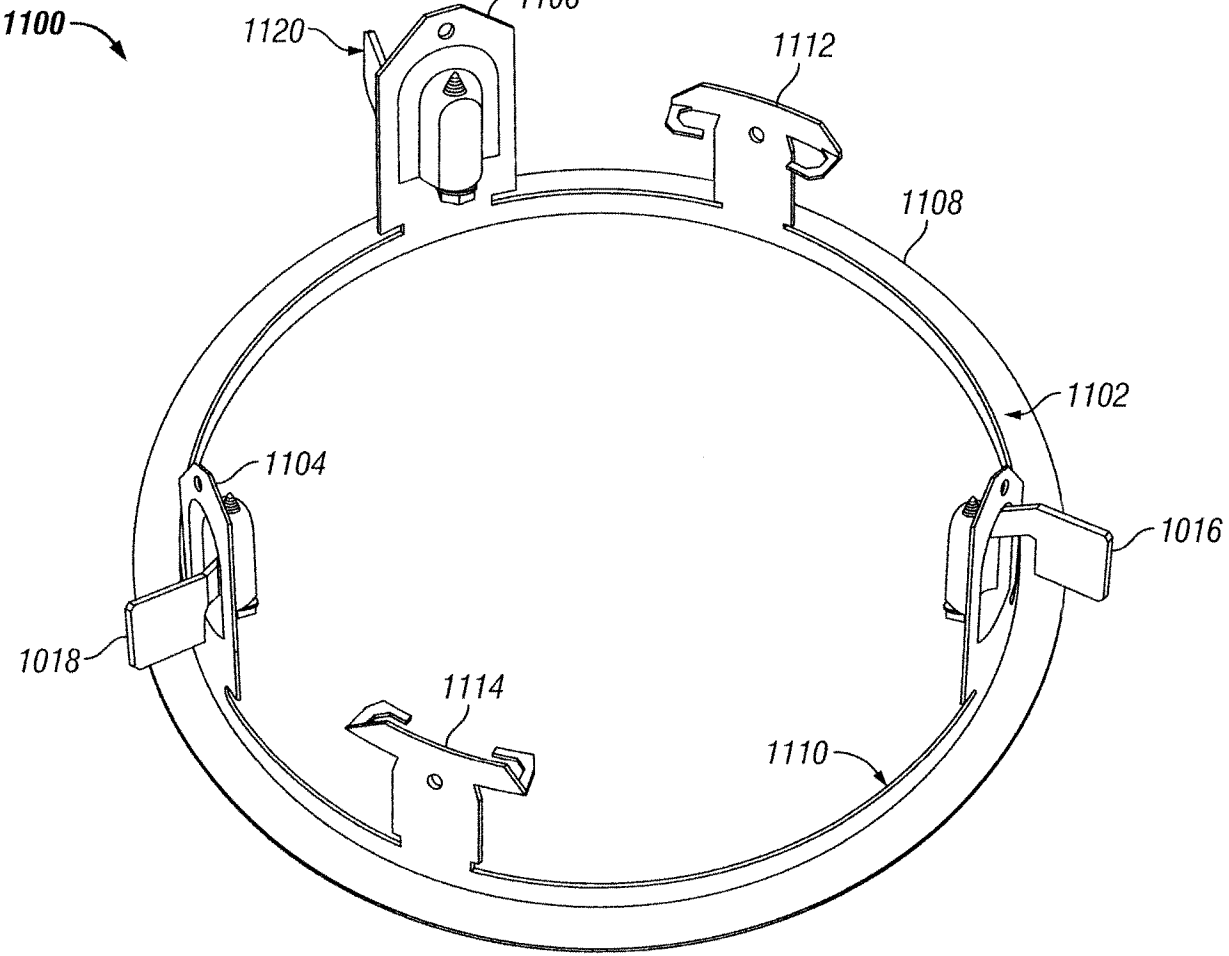
FIG. 11 illustrates a lighting fixture retention structure according to another example embodiment.
Figure 12:
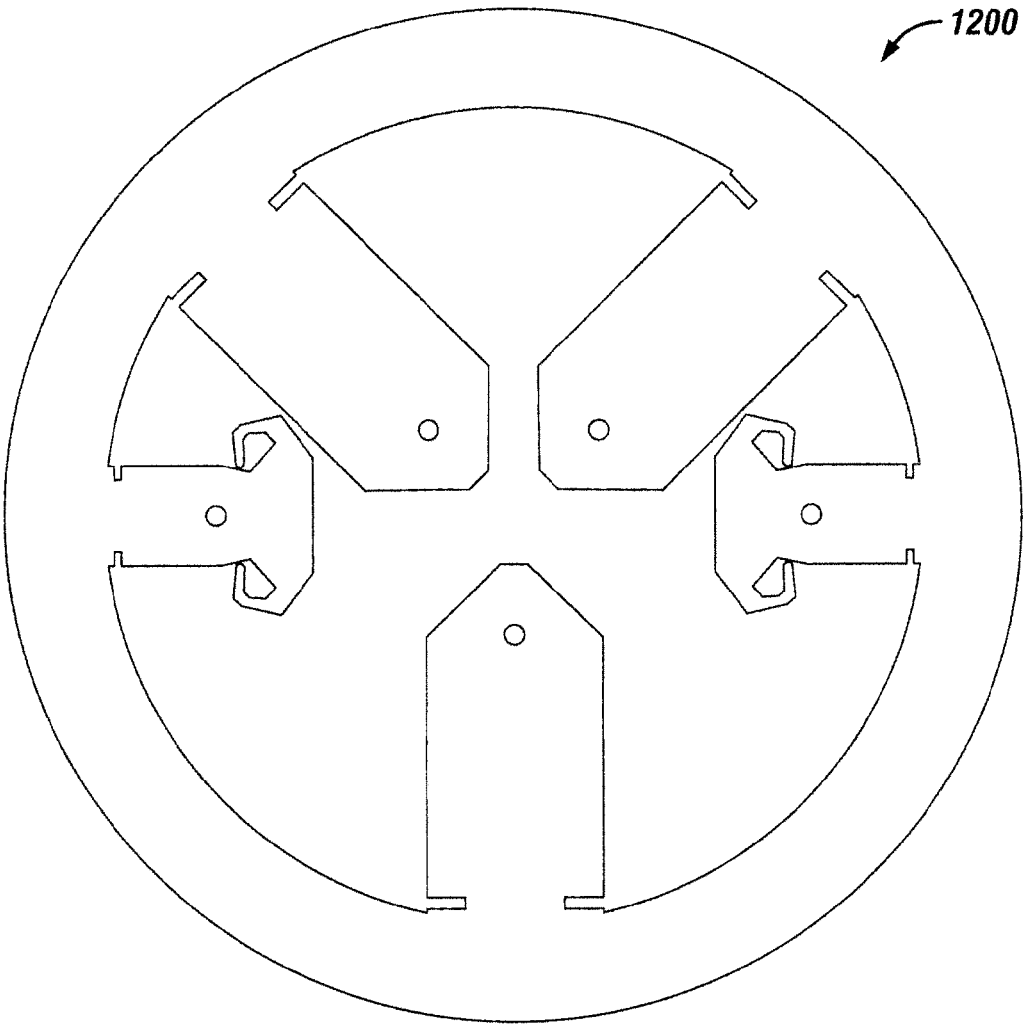
FIG. 12 illustrates a layout of sheet metal that is used to form the lighting fixture retention structure of FIG. 11 according to an example embodiment.
Figure 13:
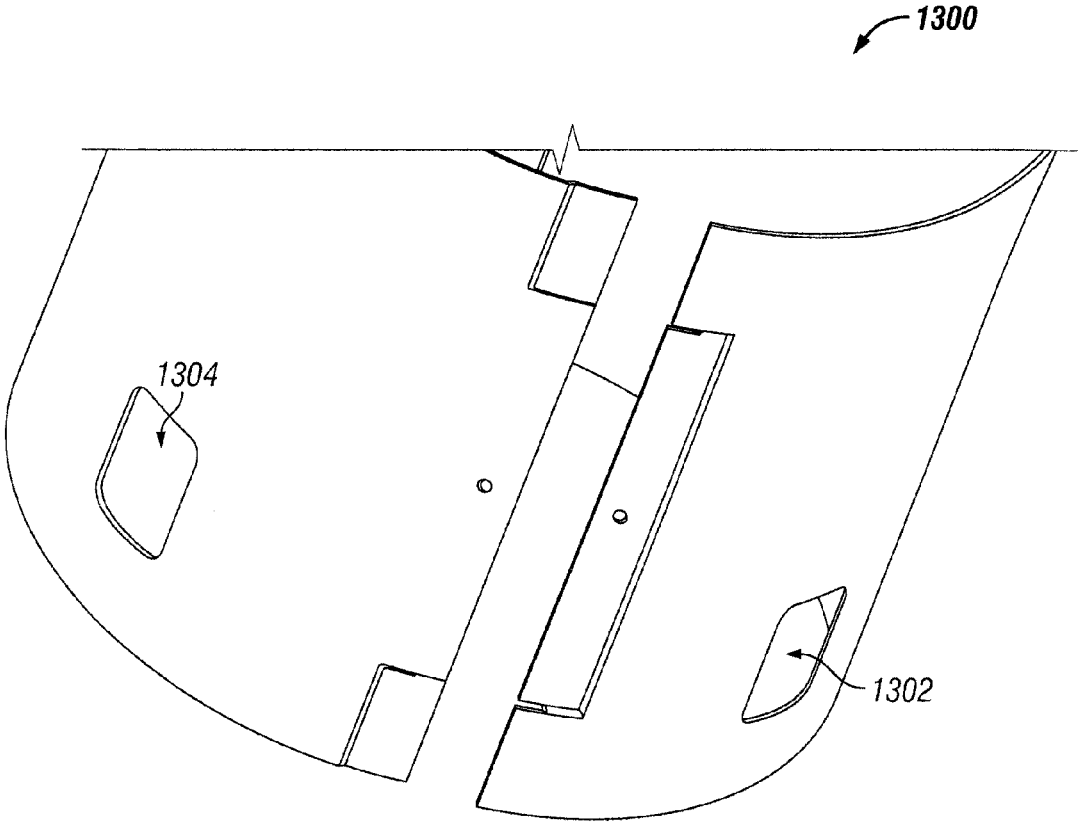
FIG. 13 illustrates windows in a light fixture housing for use with the lighting fixture retention structures of FIGS. 10 and 11 according to an example embodiment.
Figure 14:
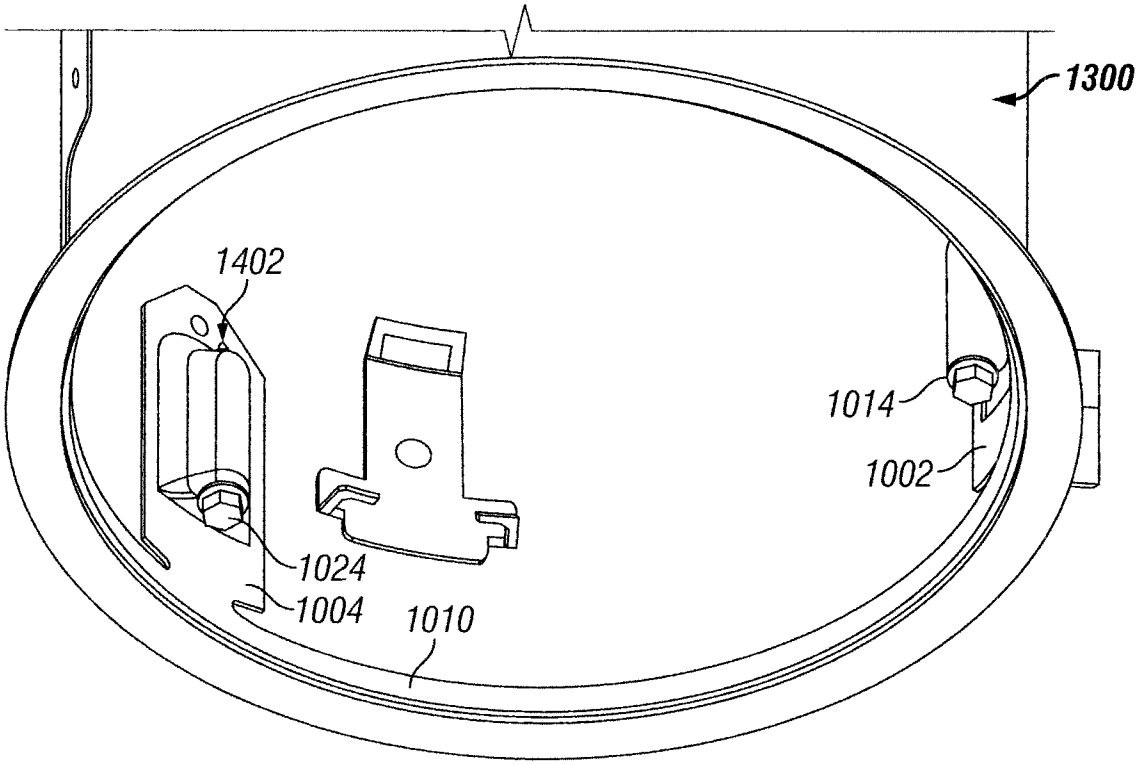
FIG. 14 illustrates the lighting fixture retention structure of FIG. 10 assembled with the housing of FIG. 13 according to an example embodiment.
Figure 15:
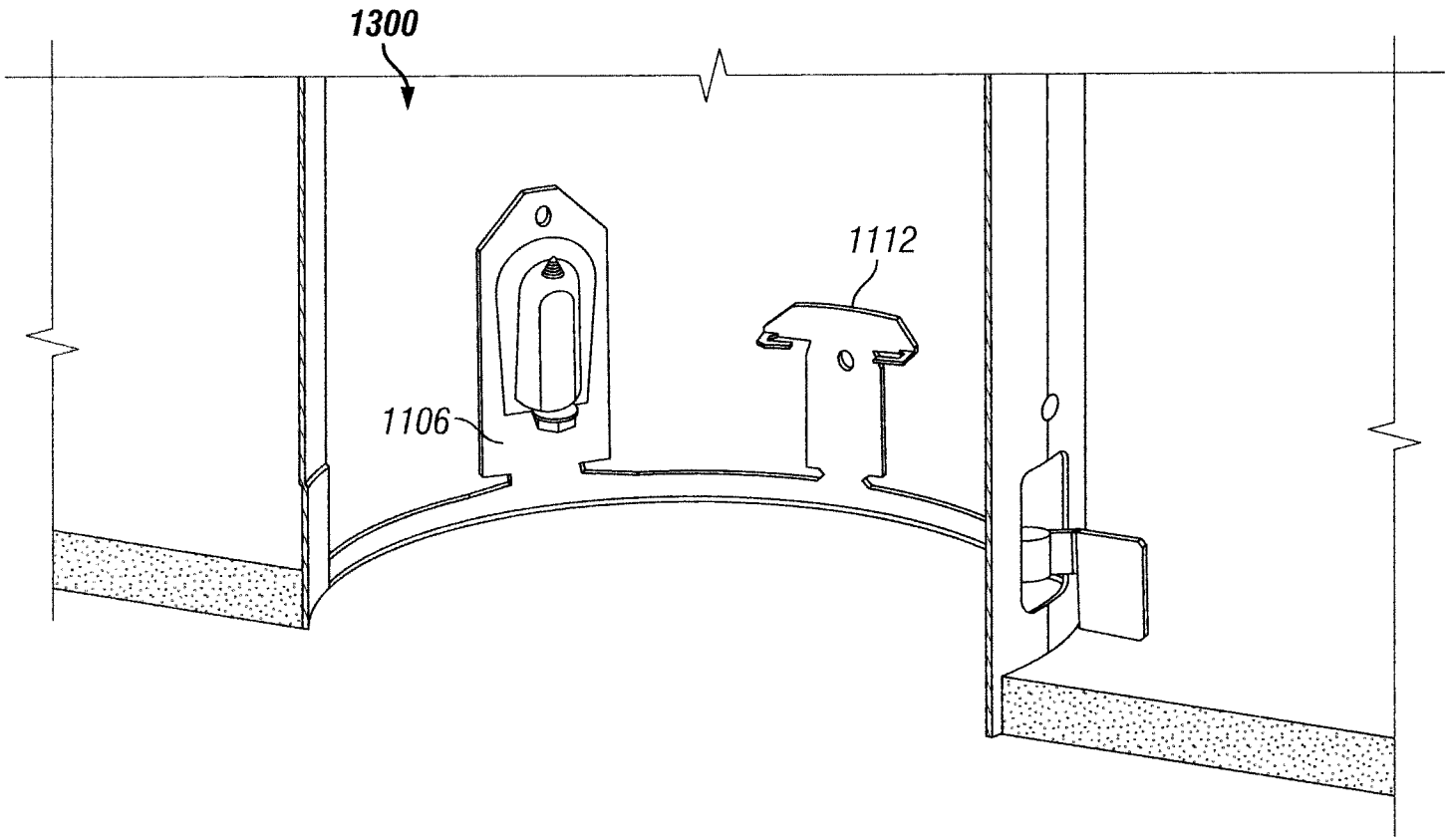
FIG. 15 illustrates a cross-sectional view of the lighting fixture retention structure of FIG. 11 assembled with the housing of FIG. 13 according to an example embodiment.
Figure 16A:
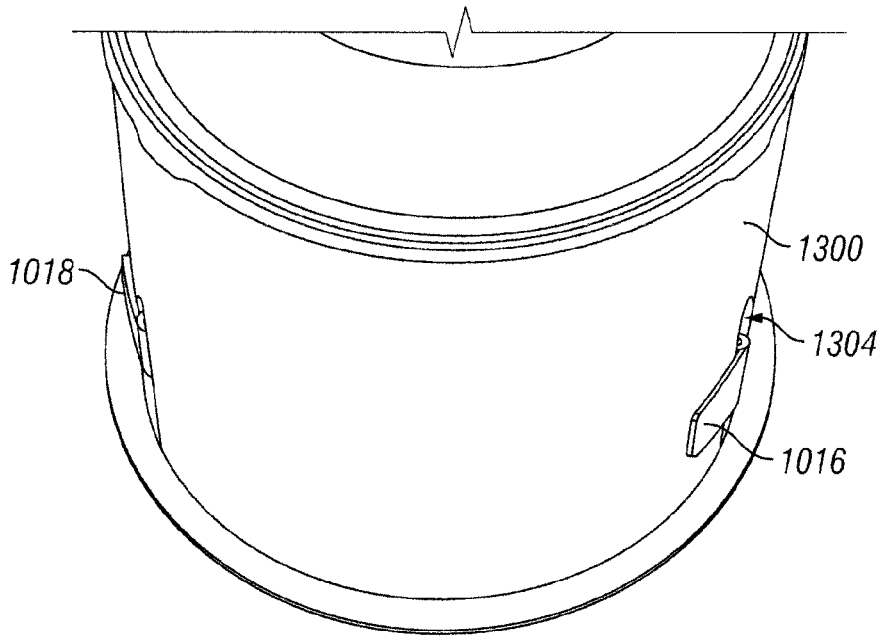
FIGS. 16A and 16B illustrate pawls of the lighting fixture retention structure of FIG. 10 in open and closed positions according to an example embodiment.
Figure 16B:
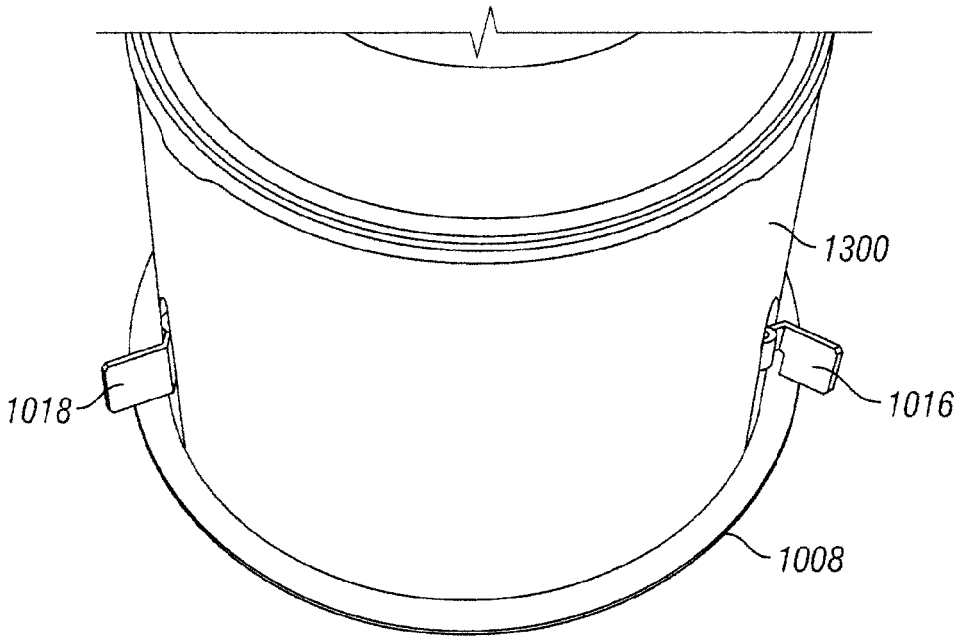

FIG. 10 illustrates a lighting fixture retention structure 1000 according to an example embodiment. FIG. 11 illustrates a lighting fixture retention structure 1100 according to another example embodiment. FIG. 12 illustrates a layout of sheet metal that is used to form the lighting fixture retention structure 1100 of FIG. 11 according to an example embodiment. FIG. 13 illustrates windows 1302, 1304 in a light fixture housing 1300 that are used with the lighting fixture retention structures 1000, 1100 of FIGS. 10 and 11 according to an example embodiment. FIG. 14 illustrates the lighting fixture retention structure 1000 of FIG. 10 assembled with the housing 1300 of FIG. 13 according to an example embodiment. FIG. 15 illustrates a cross-sectional view of the lighting fixture retention structure 1100 of FIG. 11 assembled with the housing 1300 of FIG. 13 according to an example embodiment. FIGS. 16A and 16B illustrate pawls of the lighting fixture retention structure 1000 of FIG. 10 in open and closed positions according to an example embodiment.

Referring to FIGS. 10 and 13-16B, in some example embodiments, the lighting fixture retention structure 1000 includes a band 1010 that is designed to fit at least partially within a lighting fixture housing (e.g., the housing 1300 of FIG. 14). The band 1010 may be a segment of a ring 1008 that includes a lip 1012. Attachment structures 1002, 1004, 1006 extend from the band 1010. Alternatively, the attachment structures 1002, 1004, 1006 may extend from another part of the band 1010. In some example embodiments, the lighting fixture retention structure 1000 may have fewer or more than three attachment structures. In some example embodiments, the band 1010 may have a non-circular shape that is designed to correspond to a shape of a light fixture housing that has a non-circular opening or shape. In some example embodiments, a respective threaded screw, such as a threaded screw 1014, extends through the attachment structures 1002, 1004, 1006. For example, the threaded screw 1014 extends through opposite sides of the attachment structure 1002. Similarly, a threaded screw having a tip 1020 and a head 1026 may be inserted through opposite sides of the attachment structure 1006.

In some example embodiments, each respective pawl 1016, 1018, 1120 (shown in FIG. 11) is rotatably attached to a respective threaded screw 1014, 1024, 1028 that extends through the respective attachment structure 1002, 1004, 1006 and is rotatable about its respective threaded screw 1014, 1024, 1028 in response to a rotation of the respective threaded screw 1014, 1024, 1028. For example, the pawl 1016 is rotatable about the threaded screw 1014. To illustrate, each pawl may be rotated between a first rotational position and a second rotational position as illustrated in FIGS. 16A and 16B. Further, each pawl 1016, 1018, 1120 is axially movable along its respective threaded screw 1014, 1024, 1028 in response to a rotation of the respective threaded screw 1014, 1024, 1028. For example, the pawl 1016 is axially movable along the threaded screw 1014 in response to a rotation of the threaded screw 1016. Similarly, the pawl 1018 is axially movable along the threaded screw 1024 in response to a rotation of the threaded screw 1024. The pawl 1120 is axially movable along the threaded screw 1028 in response to a rotation of the threaded screw 1028.

In some example embodiments, the rotation of the thread screw 1014, 1024, 1028 in a first rotational direction may rotate the respective pawl 1016, 1018, 1120 in the same rotational direction until the respective pawl 1016, 1018, 1120 encounters adequate resistance that prevents further rotation of the pawl in the particular rotational direction. Further rotation of the threaded screw in the same rotational direction may result in an axial movement of the pawl 1016, 1018, 1120 in a first axial direction along the respective thread screw 1014, 1024, 1028 while the pawl 1016, 1018, 1120 remains in a substantially the same rotational position. A rotation of the thread screw 1014, 1024, 1028 in a second rotational direction (i.e., opposite to the first rotational direction) may result in a rotation of the pawl 1016, 1018, 1120 in the second rotational direction if the pawl 1016, 1018, 1120 does not encounter a resistance that prevents rotation of the pawl 1016, 1018, 1120.

If the pawl 1016, 1018, 1120 encounters a resistance that prevents rotation of the pawl 1016, 1018, 1120 in the second direction, the pawl 1016, 1018, 1120 may move in a second axial direction (i.e., opposite to the first axial direction) in response to further rotation of the threaded screw 1014, 1024, 1028 in the second rotational direction. If the resistance against rotation of the pawl 1016, 1018, 1120 in the second rotational direction is reduced to allow rotation of the pawl 1016, 1018, 1120 after the axial movement of the pawl 1016, 1018, 1120, the pawl 1016, 1018, 1120 may rotate further in the second rotational direction (i.e., in response to the rotation of the threaded screw 1014, 1024, 1028 in the second rotational direction) until the pawl 1016, 1018, 1120 encounters further resistance that prevents further rotation of the pawl 1016, 1018, 1120 in the second rotational direction. The pawl 1016, 1018, 1120 may move further in the second axial direction in response to the rotation of the threaded screw 1014, 1024, 1028 in the second rotational direction until the pawl 1016, 1018, 1120 encounters a resistance that prevents further axial movement. In some example embodiments, the pawl 1004 of FIG. 1 and the pawls 1016, 1018, 1120 along with respective attachment structures function in a similar manner to retain a lighting fixture in a recessed position.

In some example embodiments, each threaded screw 1014, 1024, 1028 may be rotated, for example, using a screw driver or a similar tool inserted into the groove(s) of the head of the threaded screw 1014, 1024, 1028, such as the head 1026 of the threaded screw 1028. For example, during installation of a light fixture housing 1300 through an opening of a ceiling structure (e.g., the opening 602 of the ceiling 602 shown in FIG. 6A), the pawls 1016, 1018, 1120 may be rotated into the positions shown in FIG. 16B after the housing 1300 is inserted through the opening such that the pawls 1016, 1018, 1120 are above the ceiling structure.

In some example embodiments, the pawls 1016, 1018, 1120 may be made from one or more materials, such as metal, plastic, or any other suitable material using a process such as extrusion, injection molding, or another suitable method. In some example embodiments, the band 1010 and the attachment structures 1002, 1004, 1006 may be made from metal such as steel. In some example embodiments, the band 1010 and the attachment structures 1002, 1004, 1006 may be made by stamping, molding, or another suitable method.

As illustrated in FIG. 11, a lighting fixture retention structure 1100 includes torsion spring receivers 1112, 1114 that extend from a band 1110 that is substantially the same as the band 1010 of FIG. 10. Each torsion spring receiver 1112, 1114 may be receive a respective torsion spring (not shown) that is used to attach a lighting fixture module (not shown) or a reflector (not shown) within a housing such as the housing 1300 of FIG. 14. In general, the lighting fixture retention structure 1100 is usable in a similar manner described with respect to the lighting fixture retention structure 1000 of FIG. 10. The lighting fixture retention structure 1100 may also be made from the same or similar material used to make the lighting fixture retention structure 1000 and may be made using the same or similar methods. To illustrate, FIG. 12 illustrates the metal plate 1200 that is used to form the lighting fixture retention structure 1100 of FIG. 11. In some example embodiments, the portions of the plate 1200 that correspond to the torsion spring receivers 1112, 1114 may be omitted to make the lighting fixture retention structure 1000 of FIG. 10.

As illustrated in FIGS. 14 to 16B, the attachment structures 1002, 1004, 1006 shown in FIG. 10 and the attachment structures 1102, 1104, 1106 of FIG. 11 may be positioned at a respective window (e.g., windows 1302, 1304 shown in FIG. 13) of the housing 1300. Each attachment structure 1002, 1004, 1006 shown in FIG. 10 and each attachment structure 1102, 1104, 1106 shown in FIG. 11 may be attached to the housing 1300 by a fastener inserted through a respective hole (e.g., the hole 1022 of FIG. 10) to attach the respective lighting fixture retention structure 1000, 1100 to the housing 1300.

Figure 17:
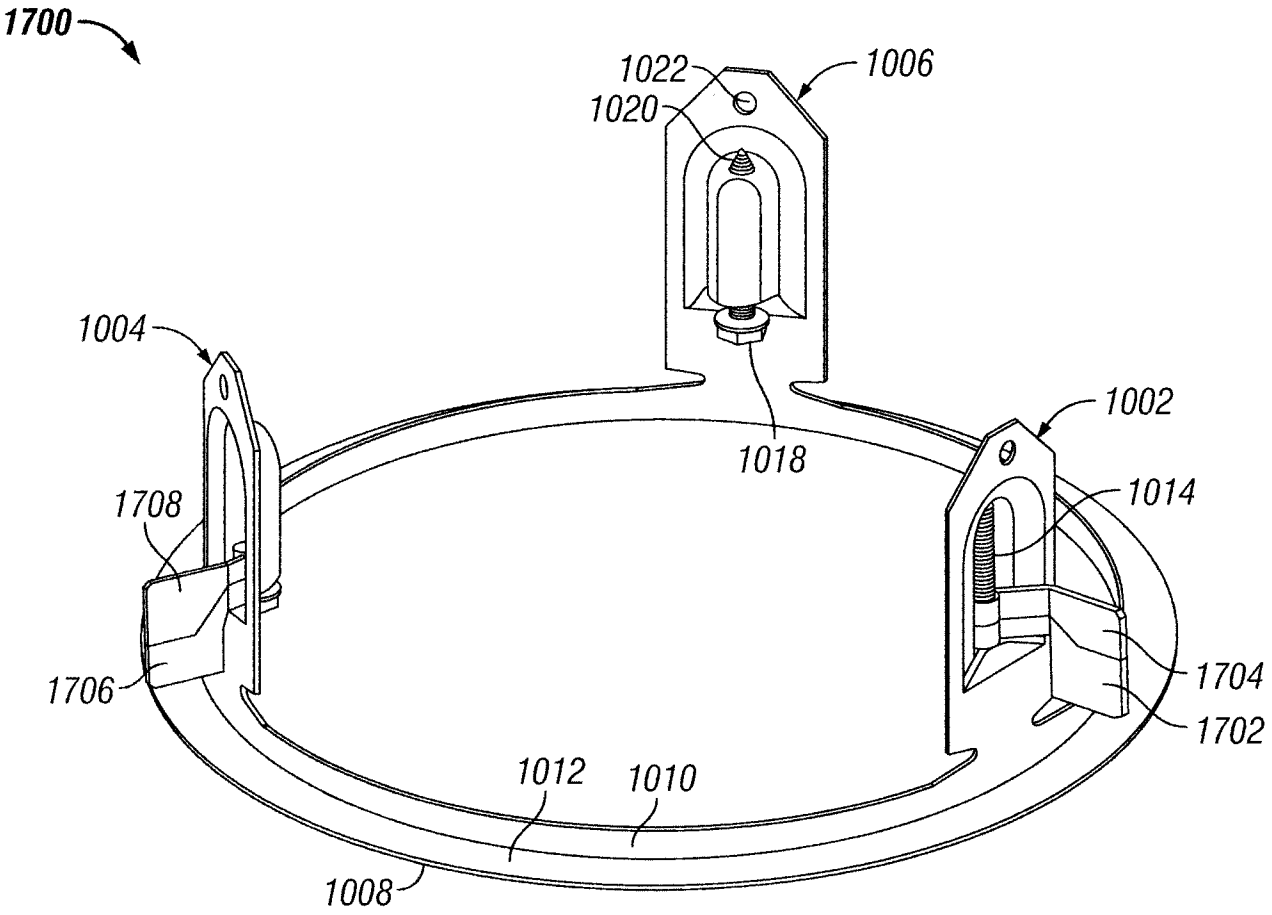
FIG. 17 illustrates a lighting fixture retention structure according to another example embodiment.
Figure 18:
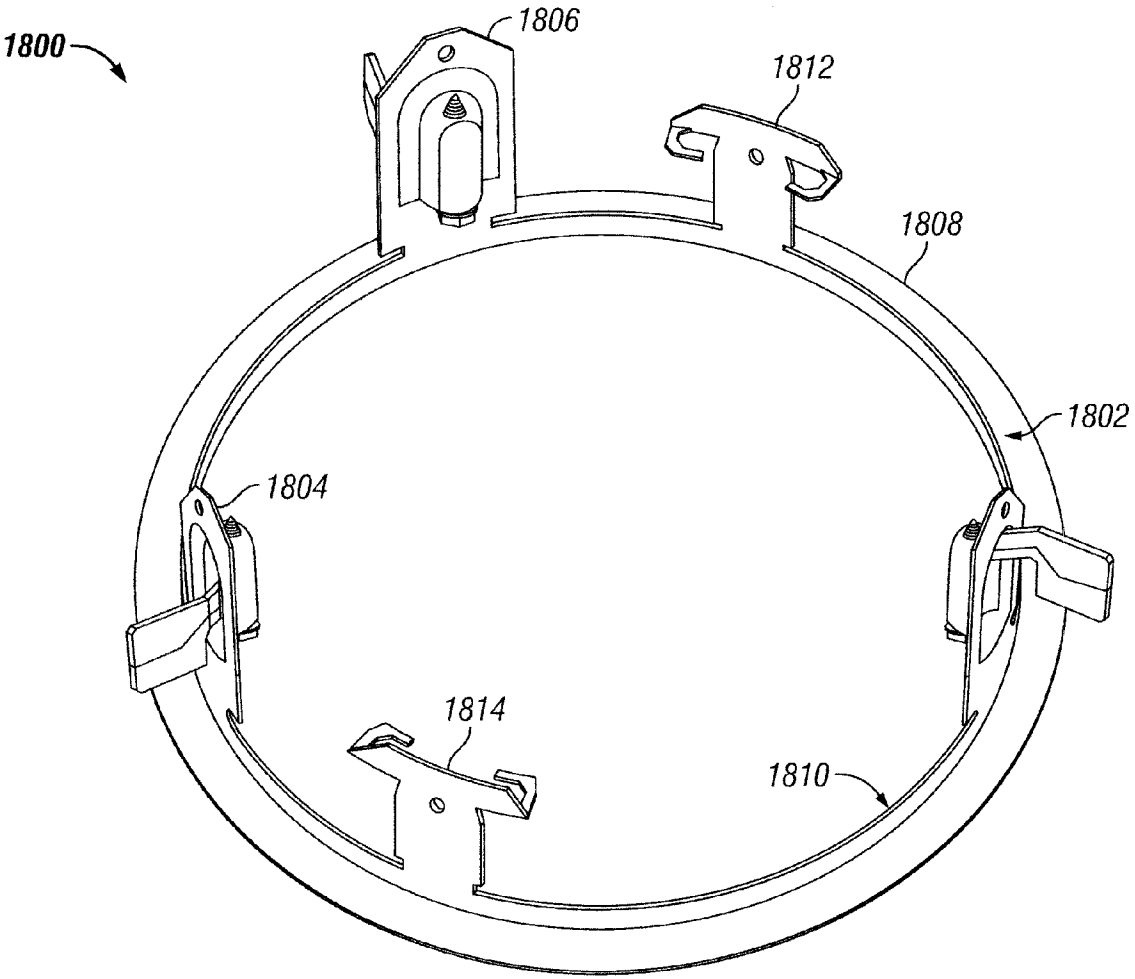
FIG. 18 illustrates a lighting fixture retention structure according to another example embodiment.
Figure 19:
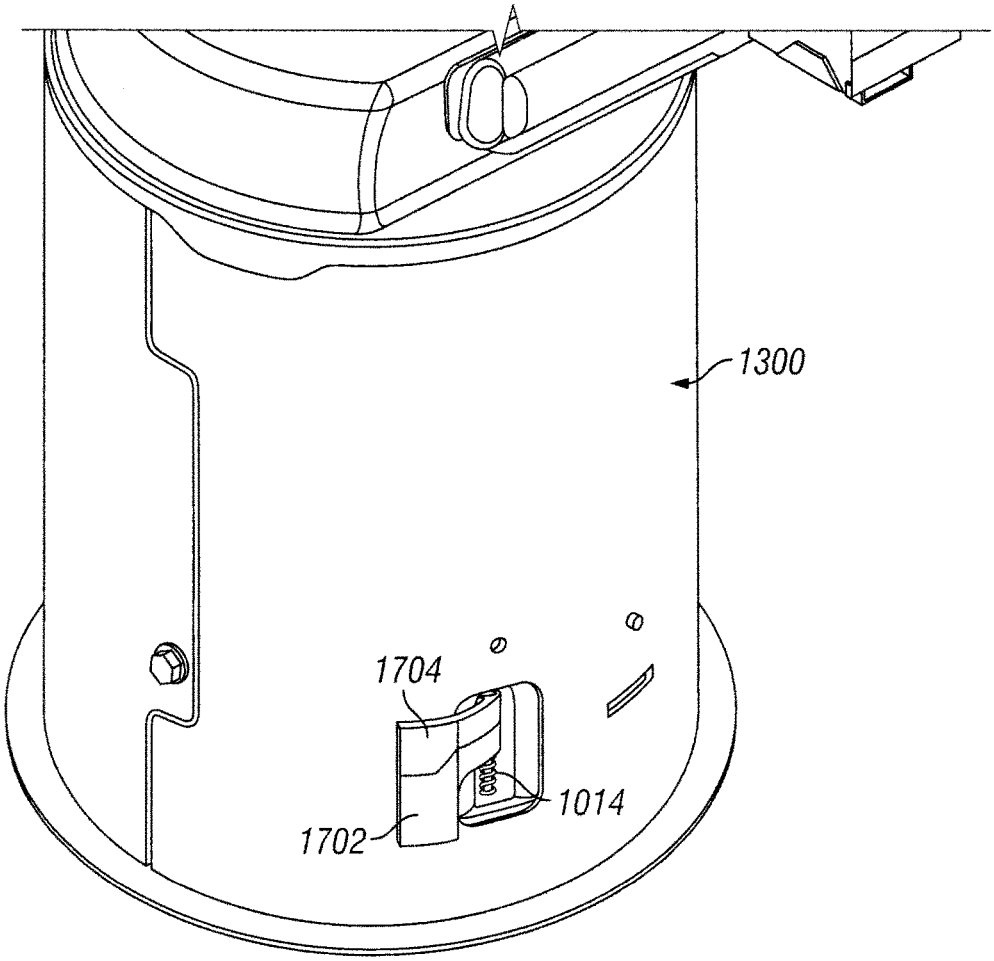
FIG. 19 illustrates the lighting fixture retention structure of FIG. 17 assembled with the housing of FIG. 13 according to an example embodiment.
Figure 20A:
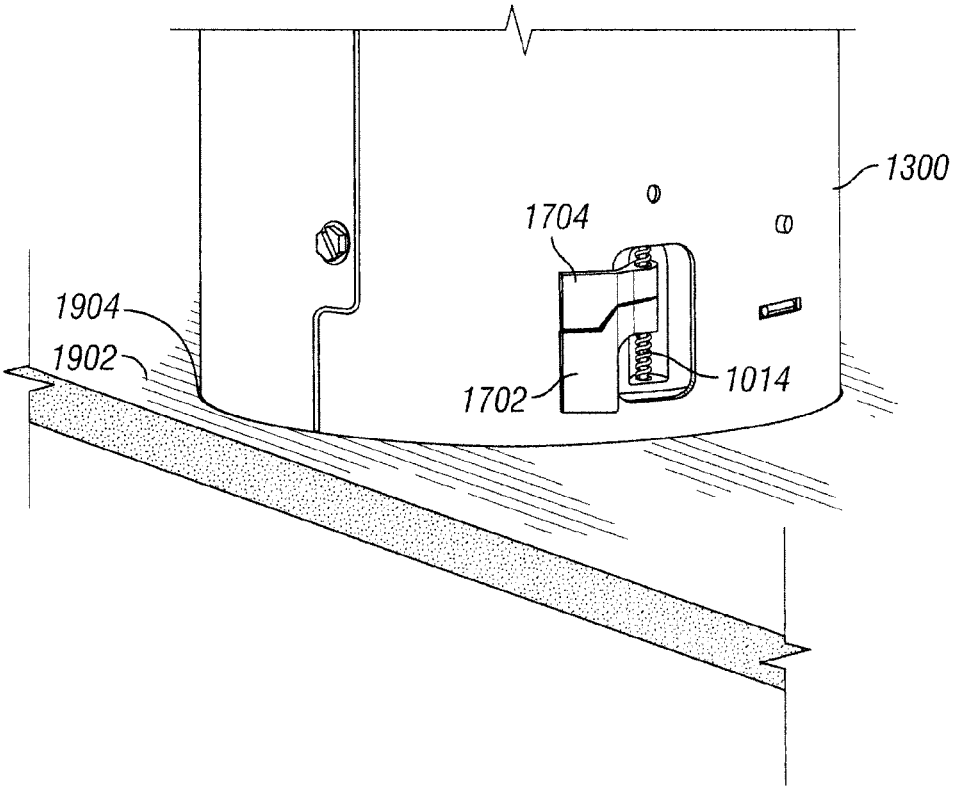
FIGS. 20A and 20B illustrate the lighting fixture retention structure of FIG. 17 assembled with the housing of FIG. 13 and inserted through an opening according to an example embodiment.
Figure 20B:
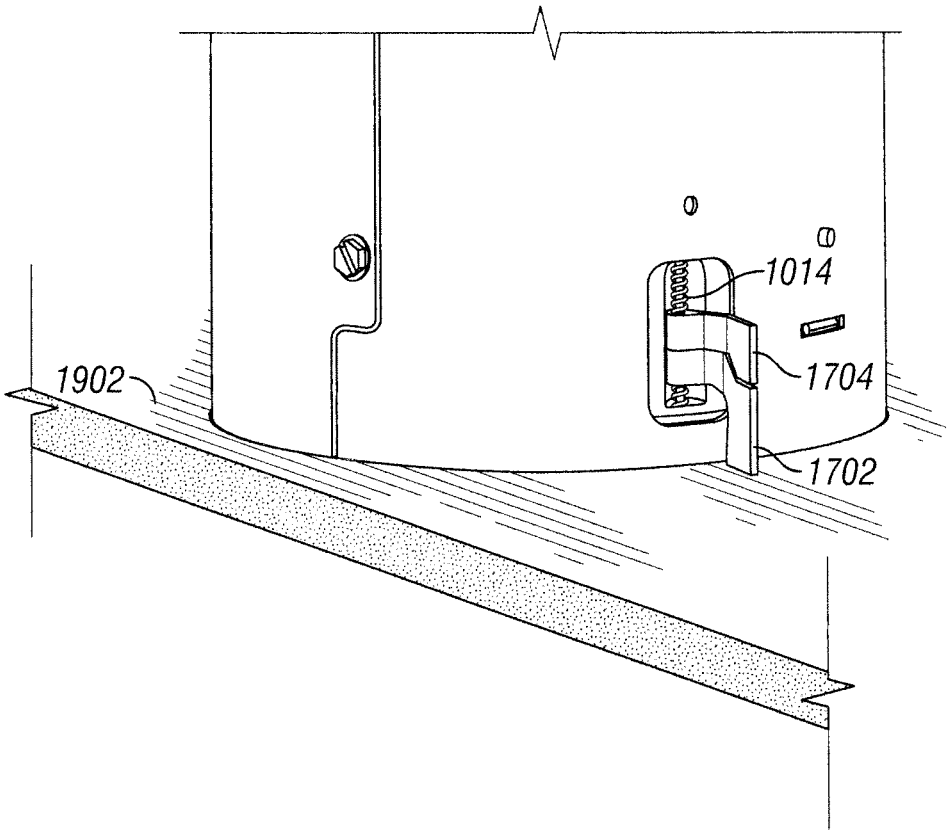
Figure 21A:
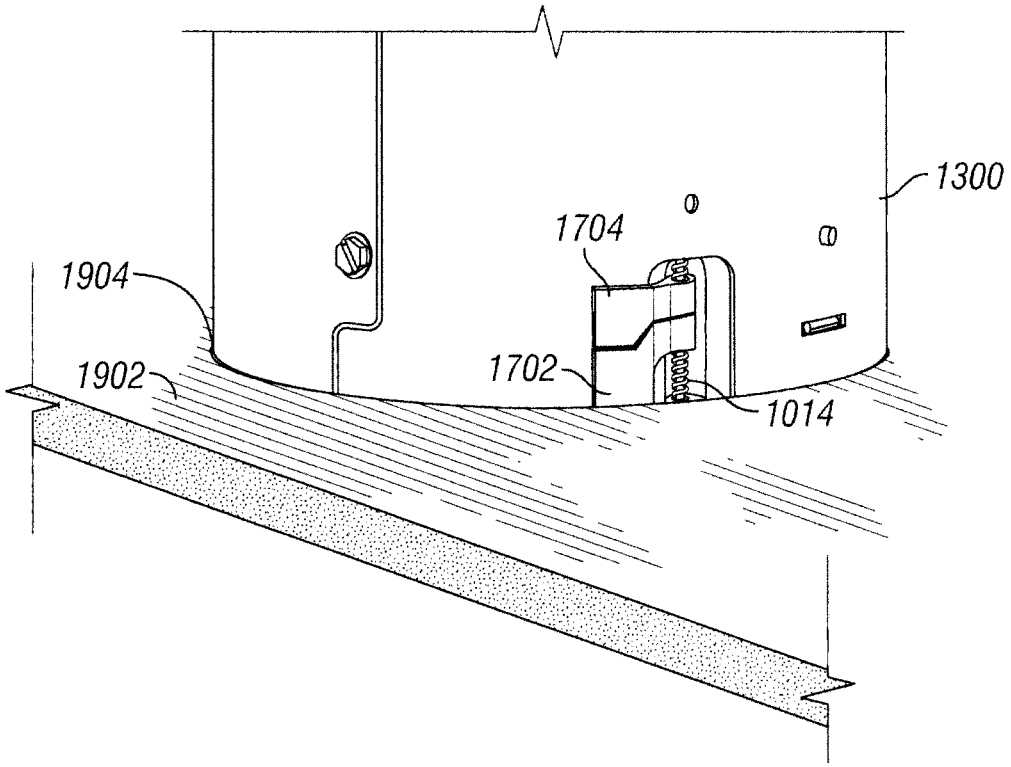
FIGS. 21A and 21B illustrate the lighting fixture retention structure of FIG. 17 assembled with the housing of FIG. 13 and inserted through an opening according to another example embodiment.
Figure 21B:
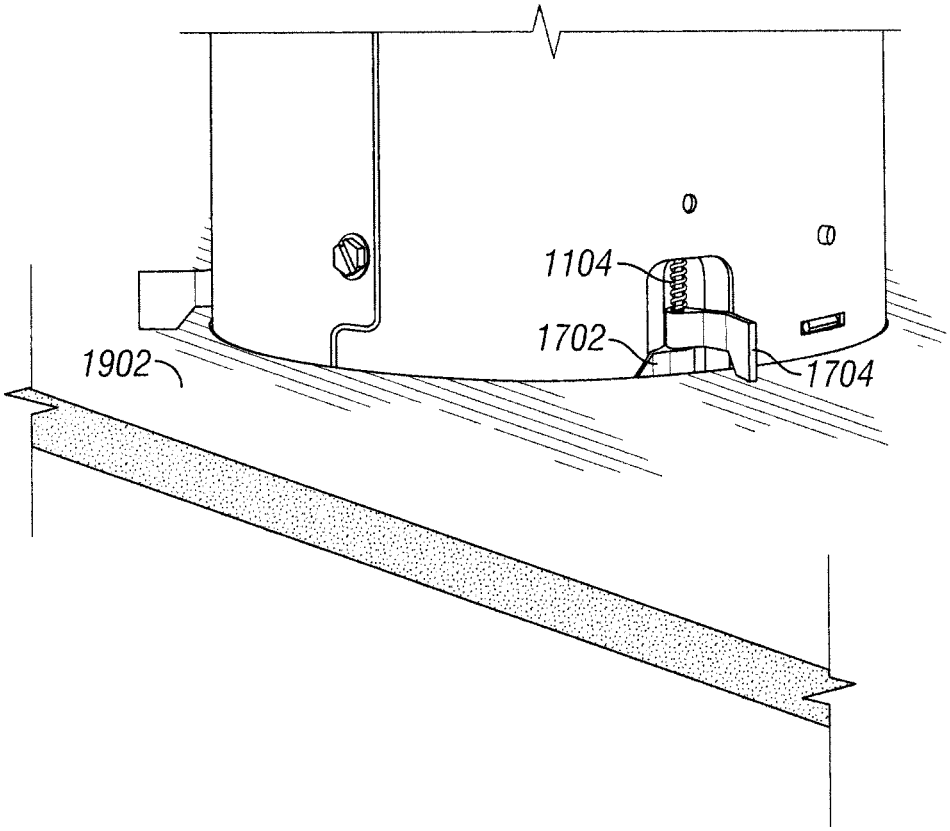

FIG. 17 illustrates a lighting fixture retention structure 1700 according to another example embodiment. FIG. 18 illustrates a lighting fixture retention structure 1800 including torsion spring receivers according to another example embodiment. FIG. 19 illustrates the lighting fixture retention structure 1700 of FIG. 17 assembled with the housing 1300 of FIG. 13 according to an example embodiment. FIGS. 20A and 20B illustrate the lighting fixture retention structure 1700 of FIG. 17 assembled with the housing 1300 of FIG. 13 and inserted through an opening 1904 of a ceiling 1902 according to an example embodiment. FIGS. 21A and 21B illustrate the lighting fixture retention structure 1700 of FIG. 17 assembled with the housing of FIG. 13 and inserted through the opening 1904 of the ceiling 1902 according to another example embodiment. Although FIGS. 19-21B are described and/or illustrated with respect to the lighting fixture retention structure 1700, the lighting fixture retention structure 1800 may be used in a similar manner described and/or illustrated with respect to the lighting fixture retention structure 1700.

Referring to FIGS. 17 and 19-21B, in some example embodiments, the lighting fixture retention structure 1700 corresponds to the lighting fixture retention structure 1000 of FIG. 10 with the primary difference being the number of pawls that are rotatably attached to the respective threaded screws. As illustrated in FIG. 17, two pawls 1702 and 1704 are rotatably attached to the threaded screw 1014 as compared to a single pawl 1016 that is attached to the threaded screw 1014 of the lighting fixture retention structure 1000 of FIG. 10. In some example embodiments, the two pawls 1702, 1704 are rotatably attached to each of the threaded screws of the lighting fixture retention structure 1700. In some alternative embodiments, the two pawls 1702, 1704 are rotatably attached to only some of the thread screws of the lighting fixture retention structure 1700. In yet other alternative embodiments, more than two pawls may be rotatably attached to each or some of the thread screws of the lighting fixture retention structure 1700.

As illustrated in FIGS. 20A and 20B, both pawls 1702, 1704 may be rotated between a first rotational position (for example, the closed position shown in FIG. 20A) and a second rotational position (for example, the open position shown in FIG. 20B). In the open position, the pawls 1702, 1704 may retain the housing 1300 (and a lighting fixture that includes the housing 1300) recessed through the opening 1904 of the ceiling 1902. For example, both pawls 1702, 1704 may be rotatable between the two rotational positions when the ceiling thickness is small enough to allow rotation of both pawls 1702, 1704. As illustrated in FIG. 20B, the pawls 1702, 1704 have move rotationally to the open position and axially to a different axial position along the threaded screw 1014. Generally, each of the pawls 1702, 1704 operates as described with respect to the pawls 1016, 1010, 1120 of the lighting fixture retention structure 1000 of FIG. 10. In some example embodiments, the thickness of the ceiling 1902 in FIGS. 20A and 20B is less than 0.75 inch and the thickness of the ceiling 1902 in FIGS. 21A and 21B is 0.75 inch or more preventing the pawl 1702 from rotating.

To illustrate, in some example embodiments, only one of the pawls 1702, 1704 may rotate between the first rotational position and the second rotational position. For example, when the ceiling 1902 is relatively thick, a side of the opening 1904 in the ceiling 1904 may prevent the pawl 1702 from rotating from a closed position to the open position. Thus, only the pawl 1704 may be rotated into the open position shown in FIG. 21B. However, as shown in FIG. 21B, both pawls 1702, 1704 can move radially from their respective positions shown in FIG. 21B even though only the pawl 1704 is rotated to the open position. Because the pawls 1702, 1704 is in the open position, the pawl 1704 (along with other respective pawls of the lighting fixture retention structure 1700) retain the housing 1300 recessed in the ceiling 1902. As described above, the rotations and/or axial movements of the pawls 1702, 1704 illustrated in FIGS. 20A-21B occur in response to rotation of the threaded screw 1014 that may result from a user (e.g., a technician) rotating the threaded screw from underneath the ceiling 1902 from within the housing 1300.

In some example embodiments, the lighting fixture retention structure 1700 of FIG. 17 may be made from the same material and in a substantially the same manner described with respect to the lighting fixture retention structure 1000 of FIG. 10. In some example embodiments, the lighting fixture retention structure 1800 of FIG. 18 may be made from the same material and in a substantially the same manner described with respect to the lighting fixture retention structure 1100 of FIG. 11.

Figure 22:
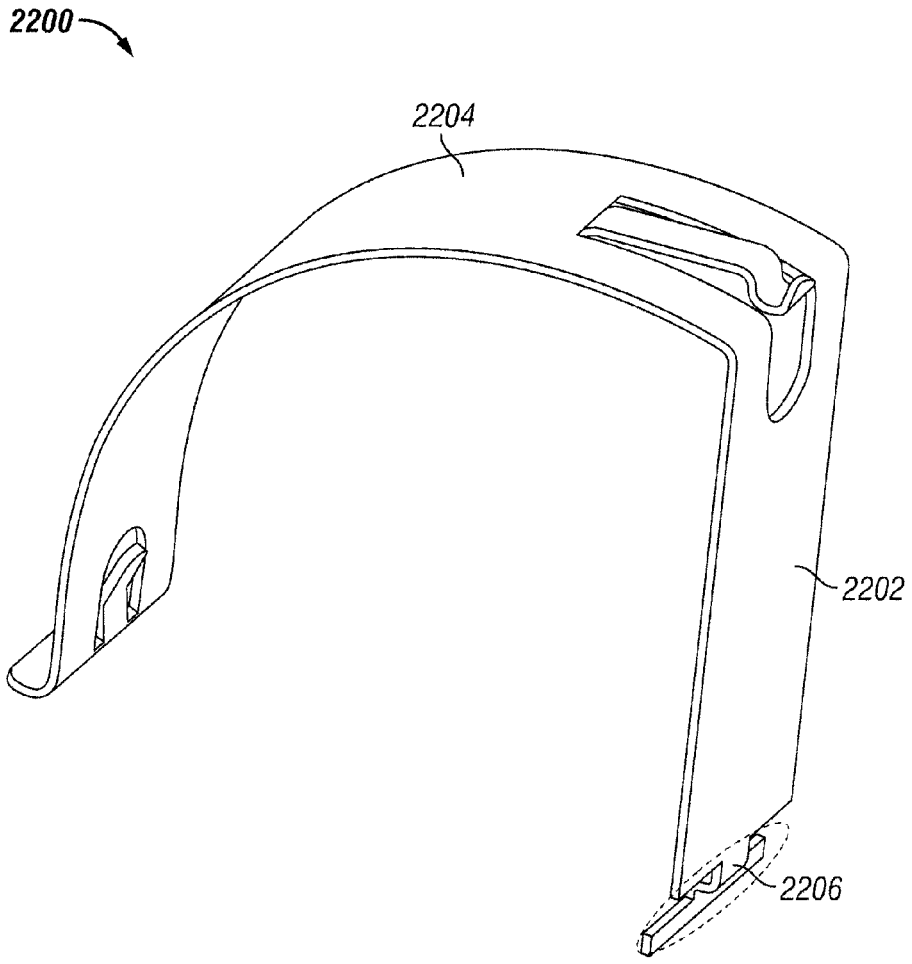
FIG. 22 illustrates a lighting fixture retention structure according to another example embodiment.
Figure 23A:
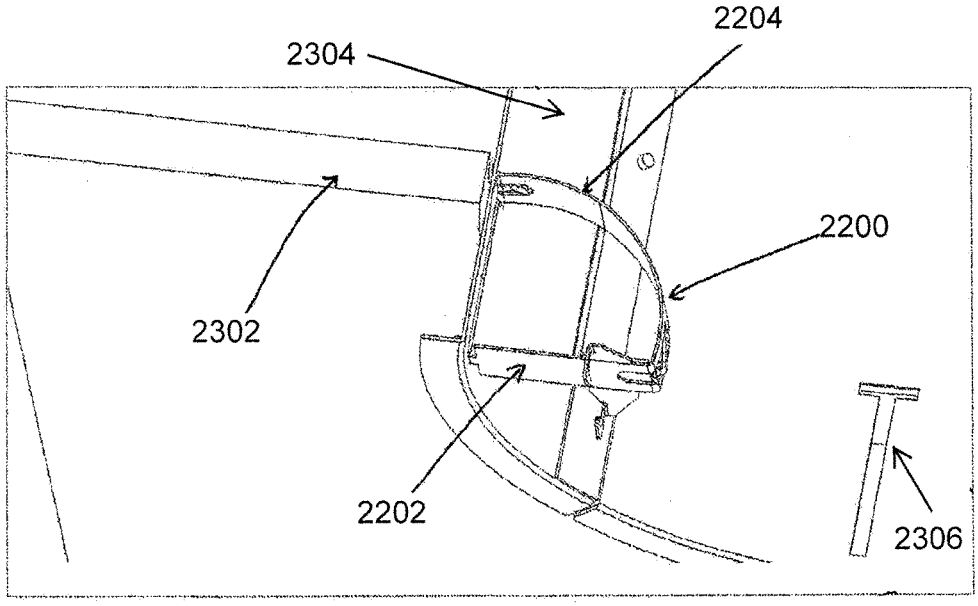
FIGS. 23A-23C illustrate various stages of the attachment of the lighting fixture retention structure of FIG. 22 to a recessed lighting fixture housing according to an example embodiment.
Figure 23B:
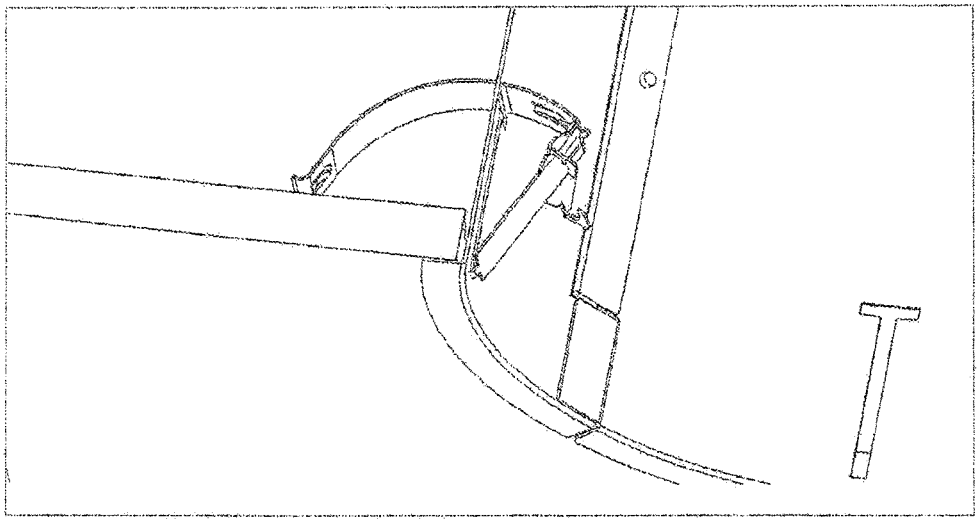
Figure 23C:
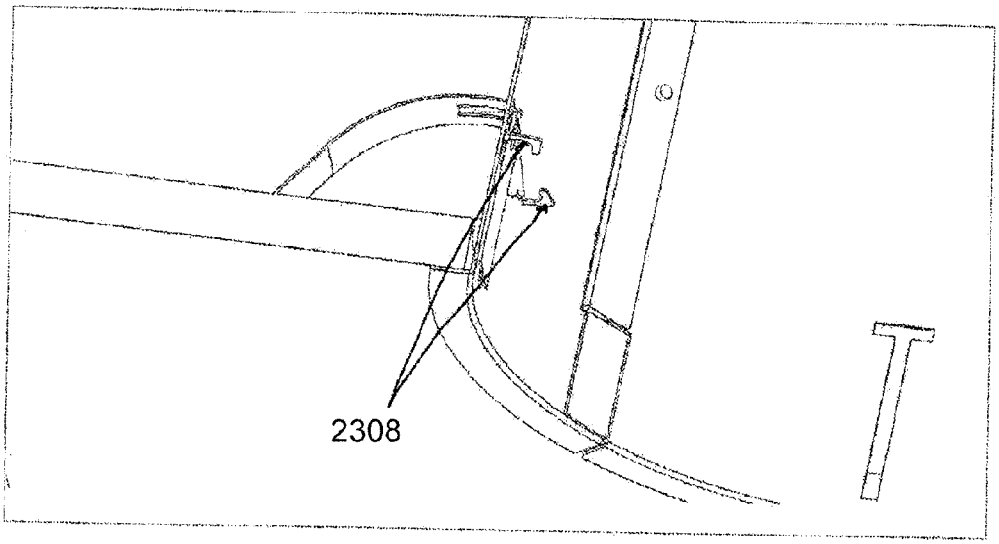
Figure 24A:
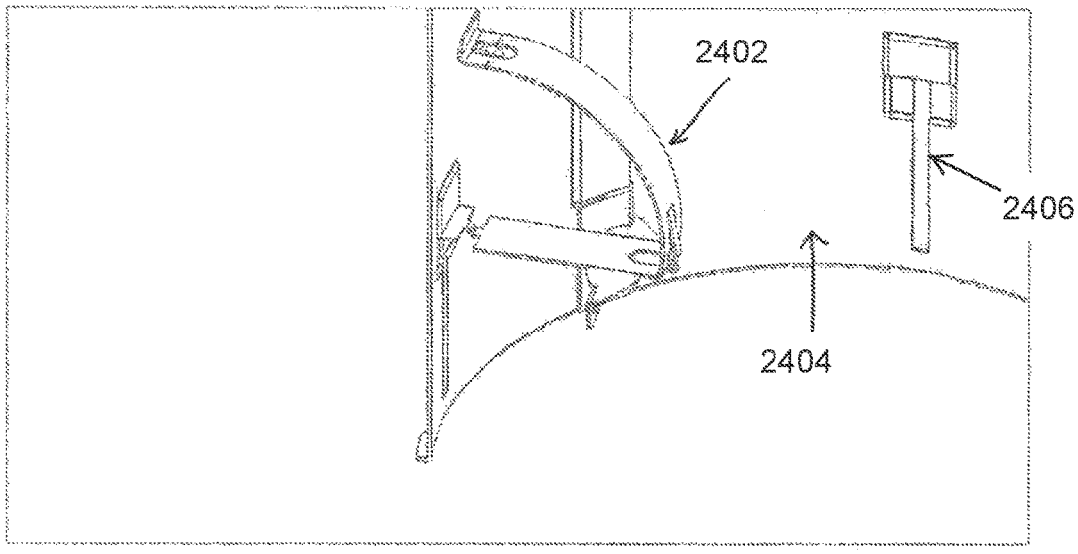
FIGS. 24A-24E illustrate various stages of the attachment of a lighting fixture retention structure to a recessed lighting fixture housing according to an example embodiment.
Figure 24B:
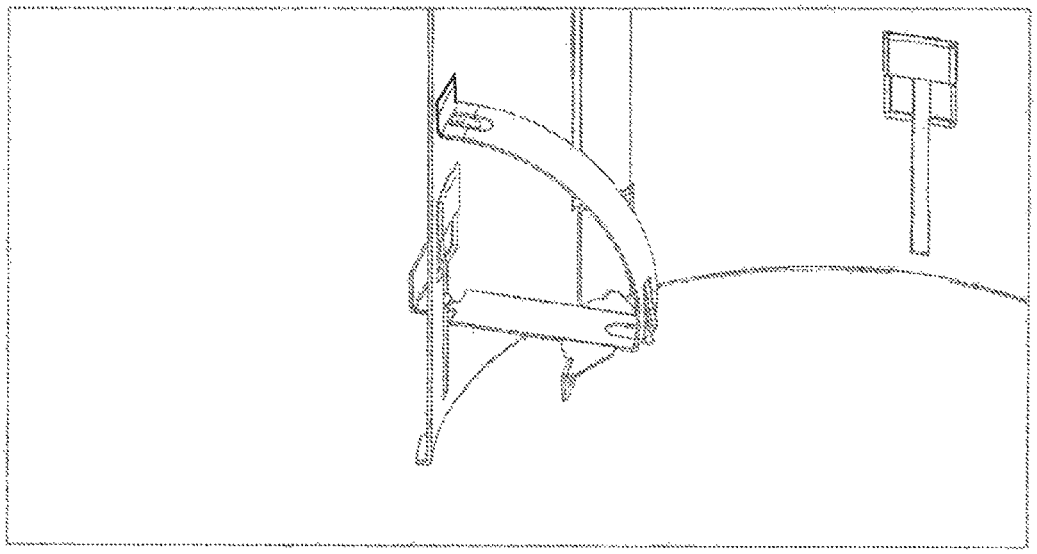
Figure 24C:
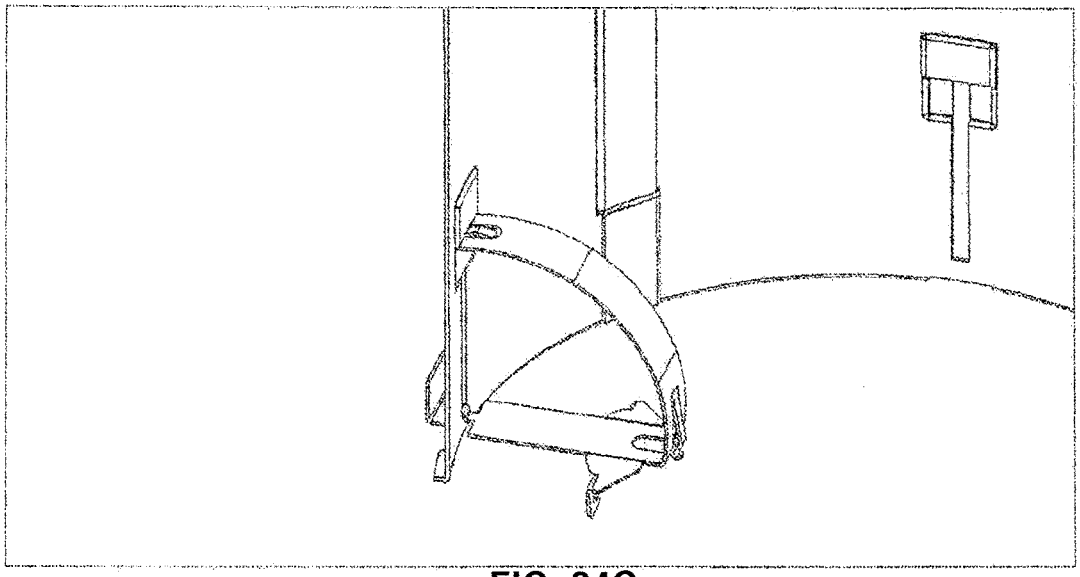
Figure 24D:
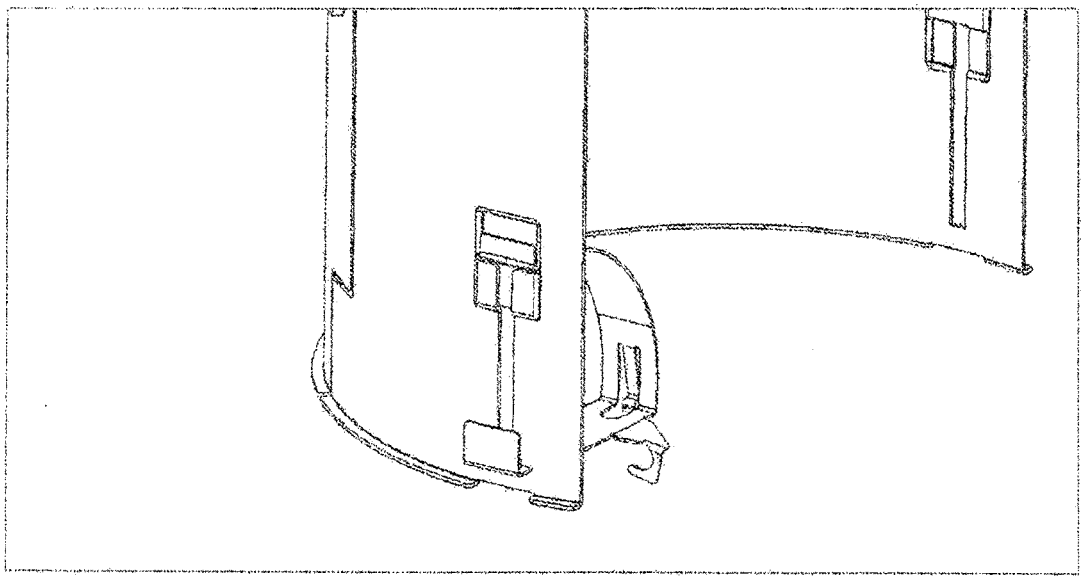
Figure 24E:
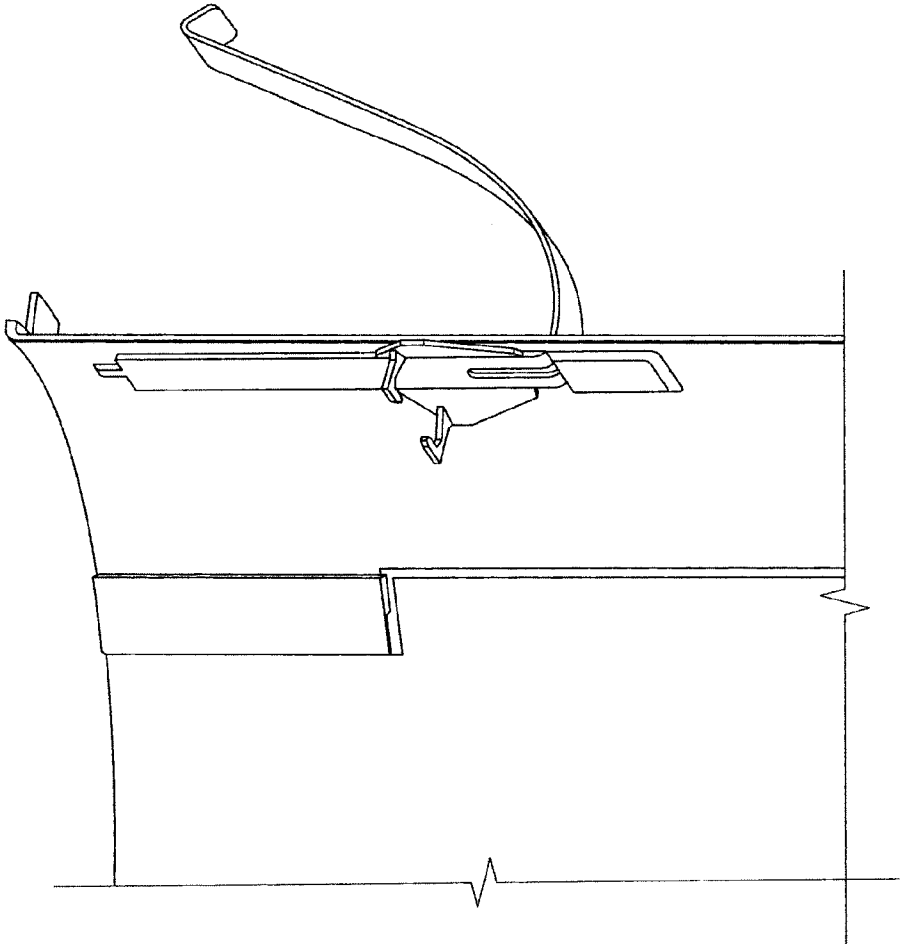

FIG. 22 illustrates a lighting fixture retention structure 2200 according to another example embodiment. FIGS. 23A-23C illustrate various stages of the attachment of the lighting fixture retention structure 2200 of FIG. 22 to a recessed lighting fixture housing according to an example embodiment. Referring to FIGS. 22-23C, the lighting fixture retention structure 2200 includes a wall segment 2202 and a tension spring segment 2204 extending from a first end portion of the wall segment 2202. The wall segment 2202 may be positioned against an inner wall of a housing 2304. The retention structure 2200 may further include a substantially T-shaped segment 2206. The housing includes a substantially T-shaped opening 2306 that has a vertical slot and a horizontal slot above the vertical slot defining the substantially T-shaped opening 2306. In some example embodiments, the housing 2304 may include two or more substantially T-shaped openings 2306. When retention structure 2200 is fully attached to the housing 2304, the tension spring segment 2204 and the substantially T-shaped segment 2206 of the retention structure 2200 are positioned outside of the housing 2304. As illustrated in FIG. 23C, a flange of the tension spring segment 2204 may rest on the back side of a ceiling 2302.

In some example embodiments, the substantially T-shaped segment 2206 has a vertical bar portion and a horizontal bar portion. The vertical bar portion extends from a second end portion of the wall segment 2202 to the horizontal bar portion. The vertical bar portion of the substantially T-shaped segment 2206 extends through the vertical slot of the substantially T-shaped opening 2306 such that the horizontal bar portion of the substantially T-shaped segment 2206 is positioned outside of the housing 2304. In some example embodiments, the lighting fixture retention structure 2200 includes a torsion spring receiver 2308 extending out from the wall segment 2202 toward a center of the housing 2304.

In some example embodiments, a lighting fixture retention system including the housing 2304 and the retention structure 2200 may be assembled by first inserting, from within the housing 2304, the T-shaped segment 2206 of the retention structure 2200 in the horizontal slot of the housing 2304 such that the horizontal bar portion of the T-shaped segment 2206 of the retention structure 2200 is positioned outside of the housing 2304. After inserting the T-shaped segment 2206, the retention structure 2200 may be slid through the vertical slot of the housing 2304 by sliding the T-shaped segment 2206 of the retention structure 2200 through the vertical slot of the housing 2304. As described above, the horizontal slot of the housing 2304 and the vertical slot of the house 2304 define the substantially T-shaped opening 2306 in the housing 2304. The tension spring segment 2204 may then be inserted in the horizontal slot of the housing 2304 such that the tension spring portion 2204 of the retention structure 2200 is positioned substantially outside of the housing 2304. As shown in FIG. 22, the T-shaped segment 2206 of the retention structure 2200 also extends from the wall segment 2202 of the retention structure 2200, and the tension spring segment 2204 of the retention structure 2200 extends from the wall segment 2202.

FIGS. 24A-24E illustrate various stages of the attachment of a lighting fixture retention structure 2402 to a recessed lighting fixture housing 2404 according to an example embodiment. The lighting fixture retention structure 2402 of FIGS. 24A-24E is similar to the lighting fixture retention structure 2200 of FIG. 22 with the primary difference being that the T-shaped segment 2206 of the retention structure 2200 a different shape than the corresponding structure of the lighting fixture retention structure 2402. Further, the housing 2404 of FIGS. 24A-24E has an opening 2406 that is different from the T-shaped opening 2306 of the housing 2304.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A lighting structure for a recessed lighting fixture, the lighting structure comprising:

a lighting fixture housing having an opening that faces a floor below the lighting fixture housing when the lighting fixture housing is recessed in a ceiling, wherein the opening is at a bottom end of the lighting fixture housing; and a junction box attached to the lighting fixture housing, wherein a first portion of the junction box proximal to the lighting fixture housing is vertically narrower than a second portion of the junction box distal from the lighting fixture housing, wherein a proximal end of the junction box is attached to the lighting fixture housing at a top end of the lighting fixture housing, wherein the junction box is tapered between a distal end of the junction box and the proximal end of the junction box, and wherein, when the lighting fixture housing is oriented such that the opening faces the floor, a first portion of a bottom wall of the junction box proximal to the lighting fixture housing is elevated relative to a second portion of the bottom wall of the junction box distal to the lighting fixture housing.

2. The lighting structure of claim 1, wherein the junction box includes a first side wall and a second side wall, wherein a bottom edge of the first side wall is slanted angularly upwards as the first side wall extends towards the lighting fixture housing, and wherein, when the lighting fixture housing is oriented such that the opening of the lighting fixture housing faces the floor, a bottom edge of the second side wall is slanted angularly upwards as the second side wall extends towards the lighting fixture housing.

3. The lighting structure of claim 2, wherein the junction box includes a back wall, wherein the bottom wall and the back wall extend between the first side wall and the second side wall, and wherein the back wall is at the distal end of the junction box.

4. The lighting structure of claim 3, wherein a cavity of the junction box is accessible via the back wall.

5. The lighting structure of claim 1, wherein the proximal end of the junction box is attached to a housing top of the lighting fixture housing.

6. The lighting structure of claim 5, wherein the lighting fixture housing is cylindrical.

7. The lighting structure of claim 5 wherein the proximal end of the junction box is attached to an attachment area of the housing top, wherein the attachment area is substantially flat.

* * * * *